US005982903A

United States Patent [19]

Kinoshita et al.

[11] Patent Number: 5,982,903

[45] Date of Patent: Nov. 9, 1999

[54] METHOD FOR CONSTRUCTION OF TRANSFER FUNCTION TABLE FOR VIRTUAL SOUND LOCALIZATION, MEMORY WITH THE TRANSFER FUNCTION TABLE RECORDED THEREIN, AND ACOUSTIC SIGNAL EDITING SCHEME USING THE TRANSFER FUNCTION TABLE

[75] Inventors: Ikuichiro Kinoshita; Shigeaki Aoki, both of Yokosuka, Japan

[73] Assignee: Nippon Telegraph and Telephone Corporation, Tokyo, Japan

[21] Appl. No.: 08/849,197

[22] PCT Filed: Sep. 26, 1996

[86] PCT No.: PCT/JP96/02772

§ 371 Date: May 27, 1997

§ 102(e) Date: May 27, 1997

[30] Foreign Application Priority Data

Sep. 26, 1995 [JP] Japan ..... 7-248159
Nov. 8, 1995 [JP] Japan ..... 7-289864

[51] Int. Cl.[6] ..... H04R 5/00

[52] U.S. Cl. ..... 381/18; 381/303; 381/26; 381/17

[58] Field of Search ..... 381/1, 17, 18, 381/19, 20, 303, 304, 305, 26, 74, FOR 125, FOR 165

[56] References Cited

U.S. PATENT DOCUMENTS

| | | | |
|---|---|---|---|
| 5,404,406 | 4/1995 | Fuchigami et al. | 381/17 |
| 5,438,623 | 8/1995 | Begualt | 381/18 |
| 5,598,478 | 1/1997 | Tanaka et al. | 381/17 |
| 5,742,689 | 4/1998 | Tucker et al. | 381/17 |
| 5,784,467 | 7/1998 | Asayama | 381/18 |
| 5,812,674 | 9/1998 | Jot et al. | 381/18 |
| 5,822,438 | 10/1998 | Sekine et al. | 381/18 |

FOREIGN PATENT DOCUMENTS

| | | | |
|---|---|---|---|
| 58-50812 | 3/1983 | Japan . | |
| 2-200000 | 8/1990 | Japan | 381/74 |
| 3-280700 | 12/1991 | Japan . | |
| 4-53400 | 2/1992 | Japan . | |
| 6-225399 | 8/1994 | Japan | 381/18 |
| 6-315200 | 11/1994 | Japan . | |
| 7-143598 | 6/1995 | Japan . | |

*Primary Examiner*—Forester W. Isen
*Assistant Examiner*—Xu Mei
*Attorney, Agent, or Firm*—Pollock, Vande Sande & Amernick

[57] ABSTRACT

In a method for constructing an acoustic transfer function table for virtual sound localization, acoustic transfer functions are measured at both ears for a large number of subjects for each sound source position and subjected to principal components analysis, and that one of the transfer functions which corresponds to a weighting vector closest to the centroid of weighting vectors obtained for each sound source position and each ear are determined as a representative.

20 Claims, 23 Drawing Sheets

SOUND SOURCE DIRECTION : REAR [ LEFT EAR ]

NUMBER OF SUBJECTS : 57

CORRELATION COEFFICIENT $\rho = 0.432$, $t(55) = 3.552$, $p > 0.999$ 22
x(t)
21
23R
ACOUSTIC SIG PROC
23L
ACOUSTIC SIG PROC
x(t) * s_r(θ)
x(t) * s_l(θ)
31R
31L
y_r(t)
y_l(t)
32
33
REC
24
s_l(θ) s_r(θ)
θ1 θ2
θ
25
TARGET POS SETTING
26
MEAS DATA STORAGE
h_l(t), h_r(t)
e_l(t), e_r(t)
27A
PC ANAL
27B
REPRES SEL
h*_l, h*_r
e*_l, e*_r
27C
DECONVOL
COMPUTING PART 27 d1
d2
d3
s_l(θ) s_r(θ)
θ1
θ2

(2 L) 2nd PRINCIPAL COMP

F(23, 1288) = 325.4, p < 0.001

(1 L) 1st PRINCIPAL COMP

F (23, 1288) = 1661.2, p < 0.001

(2r) 2nd PRINCIPAL COMPONENT $F(23, 1288) = 249.2, p < 0.001$ (1r) 1st PRINCIPAL COMPONENT $F(23, 1288) = 1228.5, p < 0.001$

| θ | -180° | -165° | -150° | -135° | -120° | -105° | -90° | -75° |
|---|---|---|---|---|---|---|---|---|
| LEFT EAR | 55 | 45 | 39 | 39 | 39 | 41 | 54 | 42 |
| RIGHT EAR | 38 | 39 | 43 | 43 | 39 | 55 | 55 | 26 |
| θ | -60° | -45° | -30° | -15° | 0° | 15° | 30° | 45° |
| LEFT EAR | 54 | 56 | 56 | 27 | 8 | 49 | 35 | 49 |
| RIGHT EAR | 20 | 8 | 8 | 8 | 27 | 27 | 8 | 55 |
| θ | 60° | 75° | 90° | 105° | 120° | 135° | 150° | 165° |
| LEFT EAR | 10 | 41 | 47 | 53 | 15 | 27 | 41 | 40 |
| RIGHT EAR | 34 | 34 | 27 | 27 | 19 | 27 | 25 | 40 |

METHOD FOR CONSTRUCTION OF TRANSFER FUNCTION TABLE FOR VIRTUAL SOUND LOCALIZATION, MEMORY WITH THE TRANSFER FUNCTION TABLE RECORDED THEREIN, AND ACOUSTIC SIGNAL EDITING SCHEME USING THE TRANSFER FUNCTION TABLE

TECHNICAL FIELD

The present invention relates to a method of building an acoustic transfer function table for virtual sound localization control, a memory with the table stored therein, and an acoustic signal editing scheme using the table.

There have been widespread CDs that delight the listeners with music of good sound quality. In the case of providing music, speech,sound environment and other audio services from recording media or over networks, it is conventional to subject the sound source to volume adjustment, mixing, reverberation and similar acoustic processing prior to reproduction of the virtual sound through headphones or loudspeaker. A technique for controlling sound localization can be used for such processing to enhance an acoustic effect. This technique can be used to make a listener perceive sounds at places where no actual sound sources exist. For example, even when a listener listens to sounds through headphones (binaural listening), it is possible to make her or him perceive the sounds as if a conversation was being carried out just behind him. It is also possible to simulate sounds of vehicles as if they were passing through in front of the listener.

Also in an acoustical environment of virtual reality or cyber space, the technique for virtual sound localization can be applicable. A familiar example of the application is the production of a sound effect in video games. Usually acoustic signals processed for sound localization are provided to a user by reproducing them from a semiconductor ROM, CD, MD, MT or similar memory; alternatively, acoustic signals are provided to the user while being processed for sound localization on a real time basis.

What is intended by the term "sound localization" is that a listener judges the position of a sound she or he is listening to. Usually the position of the sound source agrees with the judged position. Even in the case of reproducing sounds through headphones (binaural listening), however, it is possible to make the listener perceive sounds as if they are generated from desired target positions. The principle of sound localization is to replicate or simulate in close proximity to the listener's eardrums sound stimuli from each sound source placed at each of the desired target positions. Convolution of the acoustic signal of the sound source with coefficients characterizing sound propagation from the target position to the listener's ears such as acoustic transfer functions, is proposed as a solution of the implementation. The method will be described below.

FIG. 1A illustrates an example of sound reproduction by using a single loudspeaker 11. Let an acoustic signal to the loudspeaker 11 and acoustic transfer functions from the loudspeaker 11 to the eardrums of left and right ears 13L and 13R of a listener 12 (which are referred to as head related transfer functions) be represented by x(t), $h_l(t)$ and $h_r(t)$, as functions of time t respectively. The acoustic stimuli in the close proximity to the left and right eardrums are as follows:

$$x(t)*h_l(t) \tag{1a}$$

$$x(t)*h_r(t) \tag{1b}$$

where the symbol "*" indicates convolution. The transfer functions $h_l(t)$ and $h_r(t)$ are represented by impulse responses that are functions of time. In the actual digital acoustic signal processing, they are each provided as a coefficient sequence composed of a predetermined number of coefficients spaced a sampling period apart.

FIG. 1B illustrates sound reproduction to each of the left and right ears 13L and 13R through headphones 15 (binaural listening). In this case, the acoustic transfer functions from the headphones 15 to the left and right eardrums (hereinafter referred to as ear canal transfer functions) are given by $e_l(t)$ and $e_r(t)$, respectively. Prior to sound reproduction, the acoustic signal x(t) is convolved by using left and right convolution parts 16L and 16R with coefficient sequences $s_l(t)$ and $s_r(t)$, respectively. At this time, acoustic stimuli at the left and right eardrums are as follows:

$$x(t)*s_l(t)*e_l(t) \tag{2a}$$

$$x(t)*s_r(t)*e_r(t) \tag{2b}$$

Here, the coefficient sequences $s_l(t)$ and $s_r(t)$ are determined as follows:

$$s_1(t)=h_l(t)/e_l(t) \tag{3a}$$

$$s_r(t)=h_r(t)/e_r(t) \tag{3b}$$

where the symbol "/" indicates deconvolution. On equality between Eqs. (1a) and (2a) and that between Eqs. 1(b) and (2b), respectively, the acoustic stimuli generated from the sound source 11 in FIG. 1A are replicated at the eardrums of the listener 12. Then the listener 12 can localize a sound image 17 at the position of the sound source 11 in FIG. 1A. That is, simulation of the sound stimuli at the eardrums of the listener generated from the sound source (hereinafter referred to as a target sound source) placed at the target position are simulated to enable her or him to localize the sound image at the target position.

The coefficient sequences $s_l(t)$ and $s_r(t)$ that are used for convolution are called sound localization transfer functions, which can also be regarded as head related transfer functions $h_l(t)$ and $h_r(t)$ that are respectively corrected by the ear canal transfer functions $e_l(t)$ and $e_r(t)$. The use of the sound localization transfer functions $s_l(t)$ and $s_r(t)$ as the coefficient sequences for convolution simulates acoustic from the sound source with higher fidelity than the use of only the head related transfer functions $h_l(t)$ and $h_r(t)$. According to S. Shimada and S. Hayashi, FASE '92 Proceeding 157, 1992, the use of the sound localization transfer functions ensures the sound localization at the target position.

Furthermore, by defining the sound localization transfer functions $s_l(t)$ and $s_r(t)$ as given by $$s_l(t)=h_l(t)/\{s_p(t)*e_l(t)\} \tag{3a}$$

$$s_r(t)=h_r(t)/\{s_p(t)*e_r(t)\} \tag{3b}$$

taking account of an acoustic input-output characteristic (hereinafter referred to as a sound source characteristic) $s_p(t)$ of the target sound source 11 with respect to the input acoustic signal x(t) thereinto, it is possible to determine sound localization transfer functions independently of the sound source characteristic $s_p(t)$.

In a sound reproduction system as shown in FIG. 2 in which the input acoustic signal x(t) of one channel is branched into left and right channels the acoustic signals x(t) in the respective channels are convolved with the head related transfer functions $h_l(t)$ and $h_r(t)$ in convolution parts 161L and 16HR and then deconvolved with the coefficients $e_l(t)$ and $e_r(t)$ or $s_p(t)*e_l(t)$ and $s_p(t)*e_r(t)$ in deconvolution parts 16EL and 16ER, respectively as follows:

$$x(t)*h_l(t)/e_l(t) \quad (2a')$$

$$x(t)*h_r(t)/e_r(t) \quad (2b')$$

$$x(t)*h_l(t)/\{s_p(t)*e_l(t)\} \quad (3a'')$$

$$x(t)*h_r(t)/\{s_p(t)*e_r(t)\} \quad (3b'')$$

Acoustic stimuli by the target sound source are simulated at the eardrums of the listener, enabling him to localize the sound at the target position.

On the other hand, in a sound reproduction system as shown in FIG. 3 using loudspeakers 11L and 11R placed on the left and right of the listener at some distance from him (which system is called a transaural system), it is possible to enable the listener to localize a sound image at a target position by reproducing sound stimuli from target sound sources in close proximity to his eardrums. Let acoustic transfer functions from the left and right sound sources (hereinafter referred to as sound sources) 11L and 11R to the eardrums of the listener's left and right ears 13L and 13R in FIG. 2, for instance, be represented by $e_{ll}(t)$ and $e_{lr}(t)$ and $e_{rl}(t)$, $e_{rr}(t)$, respectively. The subscripts l and r indicate left and right; for example, $e_{ll}(t)$ represents an acoustic transfer function from the left sound source 11L to the eardrum of the left ear 13L. In this instance acoustic signals are convolved by the convolution parts 16L and 16R with coefficient sequences $g_l(t)$ and $g_r(t)$ prior to sound reproduction by the sound sources 11L and 11R. Acoustic stimuli at the left and right eardrums are given as follows:

$$x(t)*\{g_l(t)*e_{ll}(t)+g_r(t)*e_{rl}(t)\} \quad (4a)$$

$$x(t)*\{g_r(t)*e_{rr}(t)+g_l(t)*e_{lr}(t)\} \quad (4b)$$

Replication of the acoustic stimuli from the target sound source at the eardrums of the listener's left and right ears, the transfer functions $g_l(t)$ and $g_r(t)$ should be determined on equality between Eqs. (1a) and (4a) and that between Eqs. (1b) and (4b). That is, the transfer functions $g_l(t)$ and $g_r(t)$ are determined as follows:

$$g_l(t)=\Delta h_l(t)/\Delta e \quad (5a)$$

$$g_r(t)=\Delta h_r(t)/\Delta e \quad (5b)$$

where $$\Delta h_l(t)=e_{rr}(t)*h_l(t)-e_{rl}(t)*h_r(t)$$

$$\Delta h_r(t)=e_{ll}(t)*h_r(t)-e_{lr}(t)*h_l(t)$$

$$\Delta e(t)=e_{ll}(t)*e_{rr}(t)-e_{lr}(t)*e_{rl}(t)$$

Taking into account the desired sound source characteristic $s_p(t)$ as is the case with Eqs. (3a') and (3b'), the transfer functions $g_l(t)$ and $g_r(t)$ should be defined as follows:

$$\Delta g_l(t)=\Delta h_l(t)/\{s_p(t)*\Delta e(t)\} \quad (5a')$$

$$\Delta g_r(t)=\Delta h_r(t)/\{s_p(t)*\Delta e(t)\} \quad (5b')$$

In the similar case of the binaural listening described previously with respect to FIG. 2, the input acoustic signal x(t) of one channel is branched into left and right channels. The acoustic signals are convolved with the coefficients $\Delta h_l(t)$ and $\Delta h_r(t)$ by the convolution parts 16L and 16R, respectively, thereafter being deconvolved with the coefficient sequence $\Delta e(t)$ or $s_p(t)*\Delta e$. Also in this instance, the acoustic stimuli from the target sound source as in the case of using Eqs. (3a) and (3b) or Eqs. (5a') and (5b') can be simulated at the eardrums of the listener's ears. Thus, the listener can localize a sound image at the target position.

It is known in the art that the listener can be made to localize a sound at a target position by applying to his headphones 14L and 14R signals obtained by convolving the sound source signal x(t) in the reproduction system of FIG. 1B by the filters 16L and 16R, with the transfer functions of, for example, Eqs. (3a) and (3b) or (3a') and (3b') measured in the system of FIG. 1A wherein the sound source is placed at a predetermined distance d from the listener and an azimuth θ to him (Shimada and Hayashi, Transactions of the Institute of Electronics, Information and Communication Engineers of Japan, EA-11, 1992 and Shimada et al, Transactions of the Institute of Electronics, Information and Communication engineers of Japan, EA-93-1, 1993, for instance). Then, pairs of transfer functions according to Eqs. (3a) and (3b) or (3a') and (3b') are all measured over a desired angular range at fixed angular intervals in the system of FIG. 1A, for instance, and the pairs of transfer functions thus obtained are prestored as a table in such a storage medium as ROM, CD, MD or MT. In the reproduction system of FIG. 1B a pair of transfer functions for a target position, is successively read out from the table and set in the filters 16L and 16R. Consequently the position of a sound image can be changed with time.

In general, the acoustic transfer function is reflected by the scattering of sound waves by the listener's pinnae, head and torso. The acoustic transfer function is dependent on a listener even if the target position and the listener's position are common to every listener. It is said that marked differences in the shapes of pinnae among individuals have a particularly great influence on the acoustic transfer characteristics. Therefore, sound localization at a desired target position is unfounded by using the acoustic transfer function obtained for another listener. Consequently, sound stimuli cannot faithfully be simulated at the left and right ears except by use of the listener's own head related transfer functions $h_l(t)$ and $h_r(t)$, sound localization transfer functions $s_l(t)$ and $s_r(t)$, or transfer functions $g_l(t)$ and $g_r(t)$ (hereinafter referred to as trans-aural transfer functions).

For implementation, it may not be feasible, however, to measure the acoustic transfer functions for each listener and for each target position. From the practical point of view, it is desirable to use a pair of left and right acoustic transfer functions as representatives for each target position θ. To meet this requirement, it has been proposed to use acoustic transfer functions measured by using a dummy head (D. W. Begault, "3D-SOUND," 1994) or acoustic transfer functions measured in respect of one subject (E. M. Wensel et al, "Localization using nonindividualized head-related transfer functions," Journal of the Acoustical Society of America 94(1),111). However, the conventional schemes lack a quantitative analysis for determination of the representatives of the acoustic transfer functions. Shimada et al have proposed to prepare several pairs of sound localization transfer functions at a target position θ (S. Shimada et al, "A Clustering Method for Sound Localization Function," Journal of the Audio Engineering Society 42(7/8), 577). Even with this method, however, the listener is still required to select the sound localization transfer function that ensures localization at the target position.

For control of acoustic environments that involves setting of the target position for virtual sound localization, a unique correspondence between the target position and the acoustic transfer function may be essential because such control entails acoustic signal processing for virtual sound localization that utilizes the acoustic transfer functions corresponding to the target position. Furthermore, the preparation of the acoustic transfer functions for each listener requires an extremely large storage area.

It is an object of the present invention to provide a method for building an acoustic transfer function table for use of virtual sound localization at a desired target position for the majority of potential listeners to localize sound images at a target position, a memory having the table recorded thereon, and an acoustic signal editing method using the table.

DISCLOSURE OF THE INVENTION

The method for building acoustic transfer functions for virtual sound localization according to the present invention comprises the steps of:

(a) analyzing principal components of premeasured acoustic transfer functions from at least one of target sound source positions to left and right ears of at least three or more subjects to obtain weighting vectors respectively based on the acoustic transfer functions;

(b) calculating a centroid of the weighting vectors for each target position;

(c) calculating a distance between the centroid and each weighting vector for each target position; and (d) determining, as representative for each target position, the acoustic transfer function corresponding to the weighting vector which gives the minimum distance, and compiling such representatives into a transfer function table for virtual sound localization.

BEST MODE FOR CARRYING OUT THE INVENTION

Introduction of Principal Components Analysis

Figure 1B:
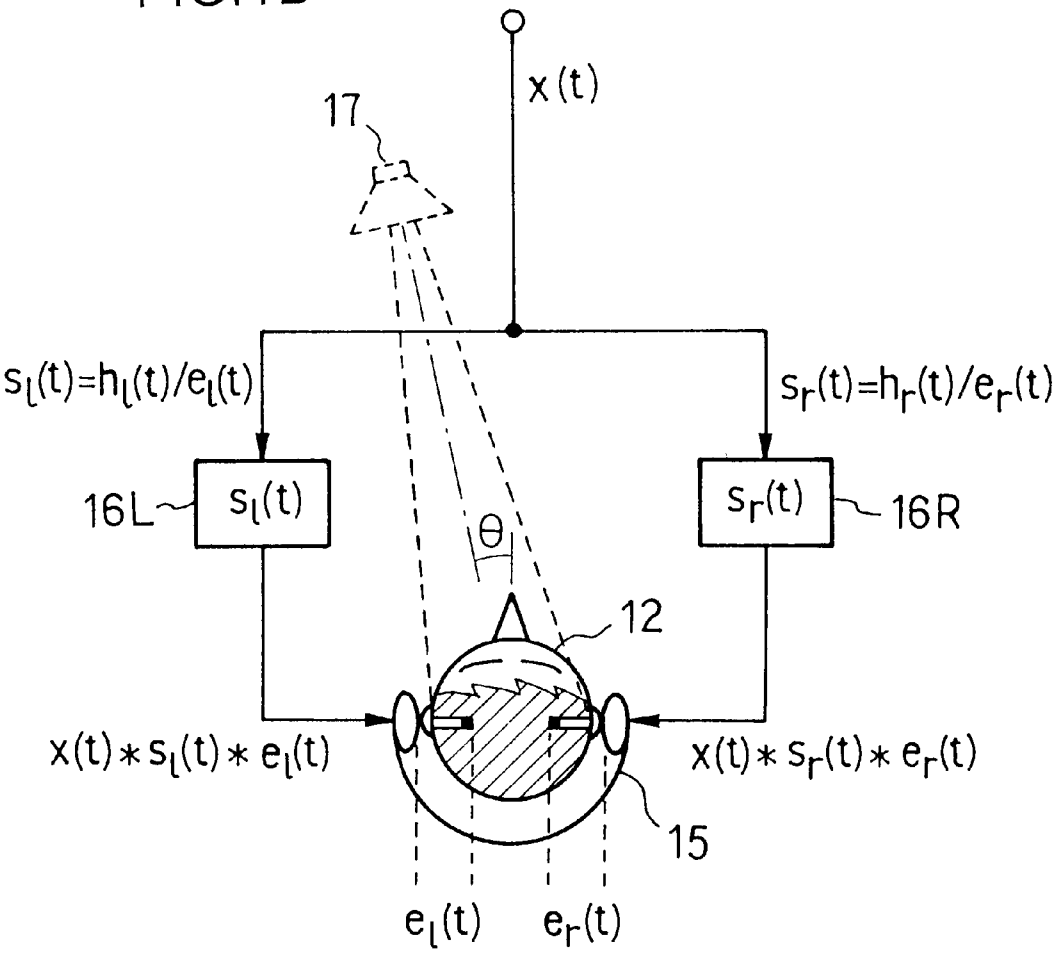
FIG. 1B is a diagram for explaining a scheme for implemention of virtual sound localization in a sound reproduction system using headphones.

In the present invention, the determination of representatives of acoustic transfer functions requires quantitative consideration of the dependency of transfer functions on a listener. The number p of coefficients that represent each acoustic transfer function (an impulse response) is usually large. For example, at the sampling frequency of 48 kHz, hundreds of coefficients are typically required, so that a large amount of processing for determination of the representatives is required. It is known in the art that the utilization of a principal components analysis is effective in the reduction of the number of coefficients representing variations by some factor. The use of the principal components analysis known as a statistical processing method allows reduction of the number of variables indicating characteristics dependent on the direction of the sound source and on the subject (A. A. Afifi and S. P. Azen, "Statistical Analysis, A Computer Oriented Approach," Academic Press 1972). Hence, the computational complexity can be decreased (D. J. Kistler and F. L. Wightman, "A Model of Head-Related Transfer Functions Based on Principal Components Analysis and Minimum-Phase Reconstruction," Journal of the Acoustical Society of America 91, pp. 1637–1647, 1992).

A description will be given of an example of a basic procedure for determining representatives. This procedure is composed of principal components analysis processing and representative determination processing. In the first stage, acoustic transfer functions $h_k(t)$ measured in advance are subjected to a principal components analysis. The acoustic transfer functions $h_k(t)$ are functions of time t, where k is an index for identification in terms of the subject's name, her or his ear (left or right) and the target position. The principal components analysis is carried out following such a procedure as described below.

The acoustic transfer functions $h_k(t)$ obtained in advance by measurements are each subjected to Fast Fourier Transform (FFT) and logarithmic values of their absolute (hereinafter referred to simply as amplitude frequency characteristics) are calculated as characteristic values $H_k(f_i)$. Based on the characteristic values $H_k(f_i)$ a variance/covariance matrix S composed of the elements $S_{ij}$ are calculated by the following equation:

$$S_{ij} = \sum_{k=1}^{n} H_k(f_i)H_k(f_j)/(n-1) \tag{6}$$

where n is the total number of acoustic transfer functions (the number of subjects×2{ left/right ears}×the number of sound source directions) and frequencies $f_i$, $f_j$ (i,j=1,2, . . . p) are a limited number of discrete values at measurable frequencies, p indicating the degree of freedom of the characteristics vector $h_k$ that represents the amplitude-frequency characteristics of the characteristic value $H_k(f_i)$:

$$h_k=[H_k(f_1),H_k(f_2), \ldots H_k(f_p)]^T$$

Accordingly, the size of the variance/covariance matrix S is p by p. Principal component vectors (coefficient vectors) are calculated as eigenvectors $u_q$ (q=,2, . . . ,p) of the variance/covariance matrix S, so that the following equation is satisfied:

$$Su_q=\lambda_q u_q \tag{7}$$

where $\lambda_q$ indicates the eigenvalue corresponding to the principal component (the eigenvectors) $u_q$. The larger the eigenvalue $\lambda_q$, the higher the contribution rate. The order q of the index of the eigenvalue $\lambda_q$ is determined in a descending order as follows:

$$\lambda_1 \geqq \lambda_2 \geqq \ldots \geqq \lambda_q \tag{8}$$

The contribution $p_q$ of a q-th principal component is given as follows for each set of characteristic values taken into consideration:

$$p_q = \lambda_q \Big/ \sum_{q=1}^{p} \lambda_q \tag{9}$$

Therefore, the accumulated contribution $P_m$ is given as follows:

$$P_m = \sum_{q=1}^{m} \lambda_q \Big/ \sum_{q=1}^{p} \lambda_q \tag{10}$$

and provides a criterion to determine the degree of freedom m of the weighting vector $w_k$.

Weighting vectors $w_k=[w_{k1},w_{k2}, \ldots ,w_{km}]^T$ composed of m weights $w_{kl}, \ldots ,w_{km}$ of respective principal component $u_1, u_2, \ldots , u_m$ contributing to amplitude-frequency characteristic $h_k=[H_k(f_1),H_k(f_2), \ldots ,H_k(f_p)]^T$ are expressed as follows:

$$w_k=Uh_k \tag{11}$$

The number of dimensions, m, of the weighting vectors $w_k$ is usually smaller than that p of the vector $h_k$. In this instance, $U=[u_1,u_2, \ldots ,u_m]^T$.

Next, processing for determining representatives will be described. The present invention selects, as representatives of acoustic transfer functions between left and right ears and each target position (θ,d), transfer functions h(t) for each subject which minimize the distances between the respective weighting vector $w_k$ and the centroid $\langle w_z \rangle$ that is the individual average of the weighting vectors. The centroid vector $\langle w_z \rangle$ is given by the following equation:

$$\langle w_k \rangle = \sum_k w_k / n_s \tag{12}$$

where $\langle w_z \rangle=[\langle w_{z1} \rangle,\langle w_{z2} \rangle, \ldots ,\langle w_{zm} \rangle]^T$ and $n_s$ is the number of subjects. The summation Σ is conducted for those k which designate the same target position and the same ear for all subjects.

For example, the Mahalanobis' generalized distance $D_k$ is used as the distance. The Mahalanobis' generalized distance $D_k$ is defined as the following equation:

$$D_k^2=(w_k-\langle w_z \rangle)^T\Sigma^{-1}(w_k-\langle w_z \rangle) \tag{13}$$

where $\Sigma^{-1}$ indicates an inverse matrix of the variance/covariance matrix Σ. Elements $\Sigma_{ij}$ of the variance/covariance matrix are calculated as follows:

$$\sum_{ij} = \sum_k (w_{kj} - \langle w_{zj} \rangle)(w_{ki} - \langle w_{kj} \rangle)/(n_s - 1) \tag{14}$$

In the present invention, the amplitude frequency characteristics of the acoustic transfer functions are expressed using the weighting vectors $W_k$. For example, according to D. J. Kistler and F. L. Wightman, "A Model of Head-Related Transfer Functions Based on Principal Components Analysis and Minimum-Phase Reconstruction," Journal of the Acoustical society of america 91, pp. 1637–1647 (1992) and Takahashi and Hamada, the Acoustical Society of Japan, proceedings (I), 2-6-19, pp. 659–660, 1994, 10-11, it is known that when listening to the sound source signal x(t) convolved with transfer functions reconstructed at an accumulated contribution $P_m$ over 90%, the listener localizes the sound at a desired position as in the case where the sound source signal is convolved with the original transfer functions.

To this end, m is chosen such that the accumulated contribution $P_m$ up to the weighting coefficients $w_{km}$ of the m-th principal component is above 90%.

On the other hand, the amplitude frequency characteristics $h_k^*$ of the transfer functions can be reconstructed as described below, using the weighting vectors $w_k$ and the coefficient matrix U:

$$h_k^* = U^T w_k \tag{15}$$

Since $m \neq p$, $h_k^* \neq h_k$. However, since the contribution by higher-order principal components is insignificant, it can be regarded that $h_k^* \approx h_k$. According to Kistler and Wightman, m is 5, while p is usually more than several hundreds at a sampling frequency of 48 kHz. Due to the principal components analysis, the number of variables (a series of coefficients) that express the amplitude frequency characteristics can be considerably reduced down to m.

The reduction of the number of variables is advantageous for the determination of representatives of acoustic transfer functions as mentioned below. First, the computational load for determination of the representatives can be reduced. Since the Mahalanobis' generalized distance defined by Eq. (13) including an inverse matrix operation, it is used as a measure for the determination of representatives. Thus, the reduction of the number of variables for the amplitude frequency characteristics significantly reduces the computational load for distance calculation. Second, the correspondence between the weighting vector and the target position is evident. The amplitude frequency characteristics have been considered to be cues for sound localization in up-down or front-back direction. On the other hand, there are factors of ambiguity in the quantitative correspondence between the amplitude frequency characteristics and target position side in the amplitude-frequency characteristics composed of a number of variables (see Blauert, Morimoto and Gotoh, "Space Acoustics," Kashima Shuppan-kai (1986), for instance).

Figure 4:
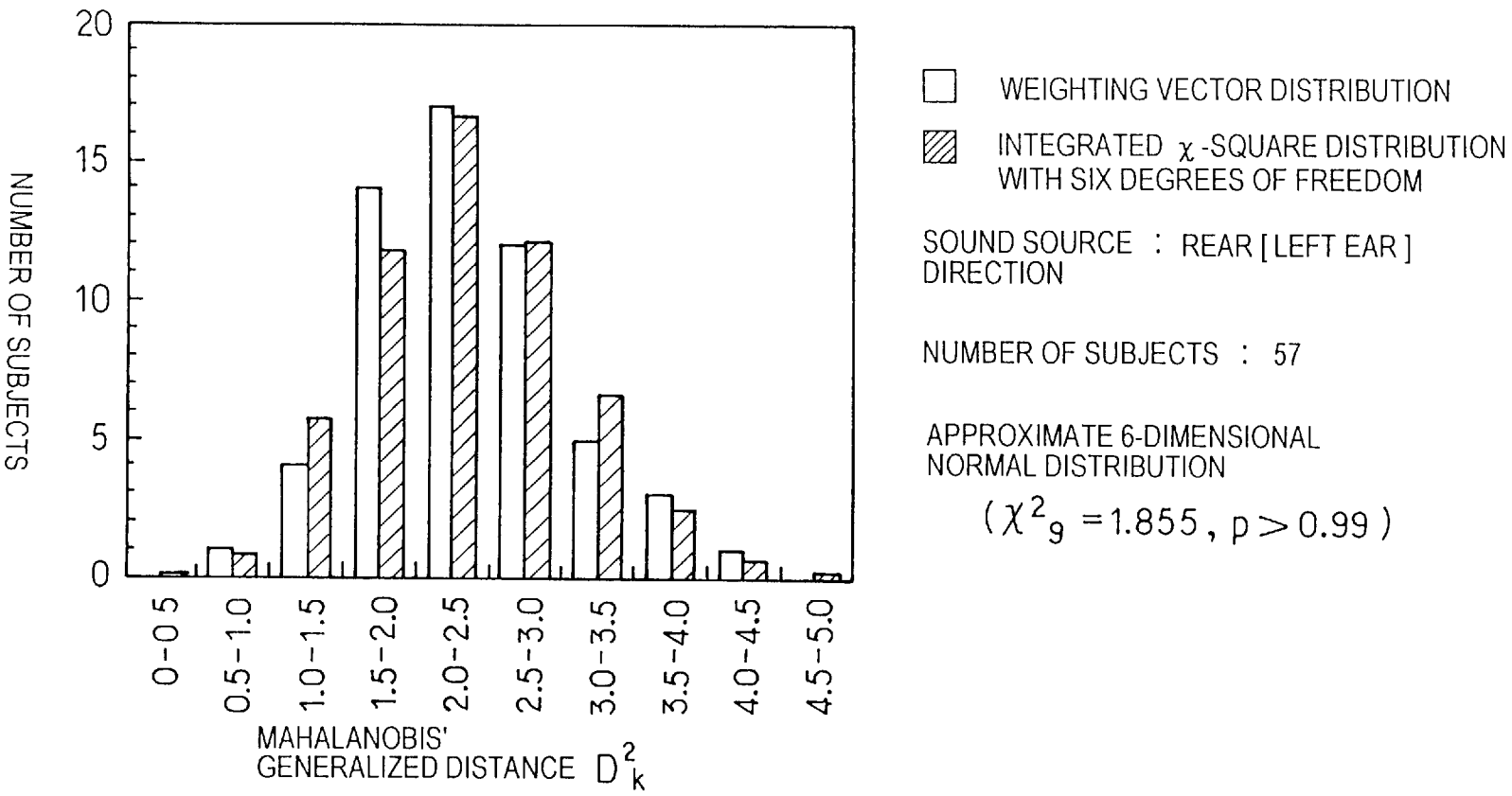
FIG. 4 shows an example of the distribution of weighting vectors as a function of Mahalanobis' generalized distance between a weighting vector corresponding to measured acoustic transfer functions and a centroid vector.

The present invention selects, as the representative of the acoustic transfer functions, a measured acoustic transfer function which minimizes the distance between the weighting vector $w_k$ and the centroid vector $\langle w_z \rangle$. According to the present inventors' experiments, the distribution of subjects as a function of square of Mahalanobis' generalized distance $D_k^2$ can be approximated to a $\chi$-square distribution of m degrees of freedom with the centroid vector <Wk> at the center as shown in FIG. 4. The distribution of weighting vectors $w_k$ can be presumed to be an m-th order normal distribution around the centroid <wk> in the vicinity of which the distribution of the vectors $w_k$ is the densest. This means that the amplitude-frequency characteristics of the representatives approximate amplitude-frequency characteristics of acoustic transfer functions measured on the majority of subjects.

The reason for selecting measured acoustic transfer functions as representatives is that they contain information such as amplitude frequency characteristics, an early reflection and reverberation which effectively contribute to sound localization at a target position. Calculation of representative by simple averaging of acoustic transfer functions over subjects, cues that contribute to localization tend to be lost due to smoothing over frequency. It is impossible to reconstruct the acoustic transfer functions using the weighting vectors $w_k$ alone, because no consideration is given to phase frequency characteristics in the calculation of the weighting vectors $w_k$. Consider the reconstruction of the acoustic transfer functions from the centroid vector $\langle w_k \rangle$. When the minimum phase synthesized from amplitude-frequency characteristics $h_k^*$ is used as the phase frequency characteristics, there is a possibility that neither initial reflection nor reverberation is appropriately synthesized. With the acoustic transfer functions measured on a sufficiently large number of subjects, the minimum distance $D_{k_sel}$ between the weighting vector $w_k$ and the centroid vector $\langle w_z \rangle$ approximates to zero.

As for a weighting vector $w_{k\text{-}max}$ among those corresponding to the representatives in a given set which provides the maximum $D_{k\text{-}max}$ between that weighting vector and the centroid vector, the distance $D_{k\text{-}max}$ is reduced by regarding the centroid vector $\langle w_z \rangle$ as the weighting vector corresponding to the representative. Further, there is a tendency in human hearing that the more similar the amplitude-frequency characteristics are to one another, that is, the smaller the distance $D_k$ between the weighting vector $w_k$ and the centroid vector $w_z$ is, the more accurate the sound localization at the target position can be resulted.

Figure 5:
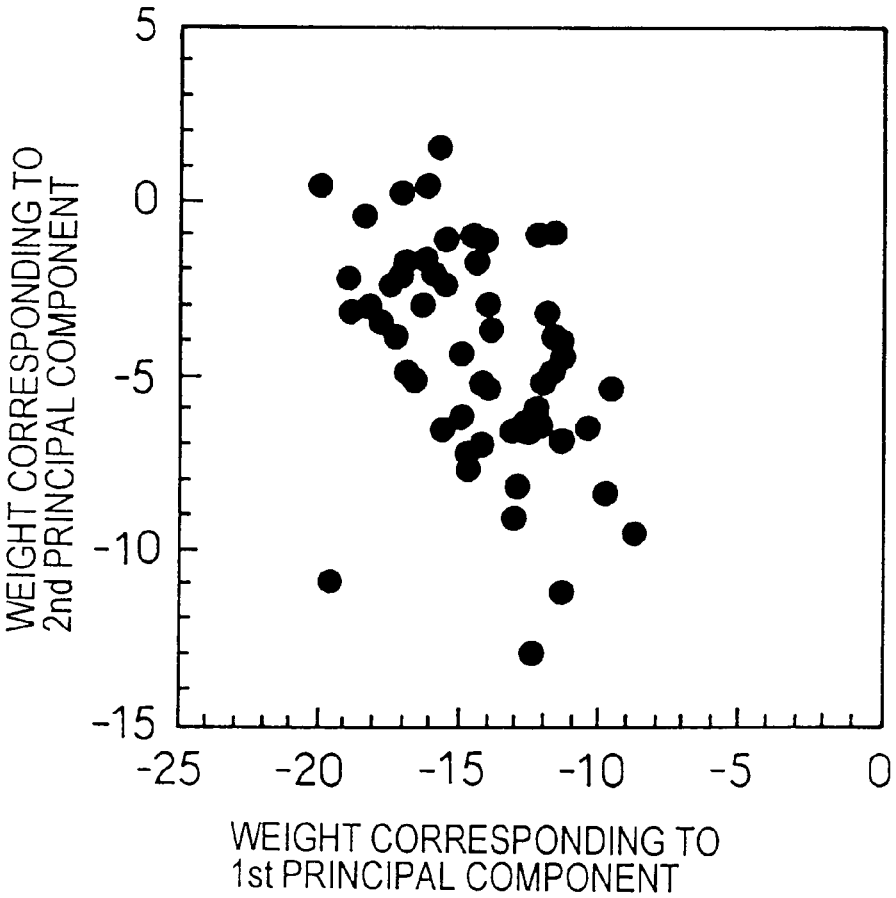
FIG. 5 shows the correlation between weights corresponding to first and second principal components.

In a preferred embodiment of the present invention, the Mahalanobis' generalized distance $D_k$ is used as the distance between the weighting vector $w_k$ and the centroid $\langle w_z \rangle$. The reason for this is that the correlation between respective principal components in the weighting vector space is taken into account in the course of calculating the Mahalanobis' generalized distance $D_k$. FIG. 5 shows the results of experiments conducted by the inventors of this application, from which it is seen that the correlation between the first and second principal components, for instance, is significant.

In another embodiment of the present invention, the acoustic transfer function from a target position to one of the ears and the acoustic transfer function to the other ear from the sound source location in an azimuthal direction laterally symmetrical to the above target sound source location are determined to be identical to each other. The reason for this is that the amplitude-frequency characteristics of the two acoustic transfer functions approximate each other. This is based on the fact that the dependency on sound source azimuth of the centroid which represents the amplitude-frequency characteristics of the acoustic transfer function for each target position and for one ear, is approximately laterally symmetrical.

Figures 6A, 6B:
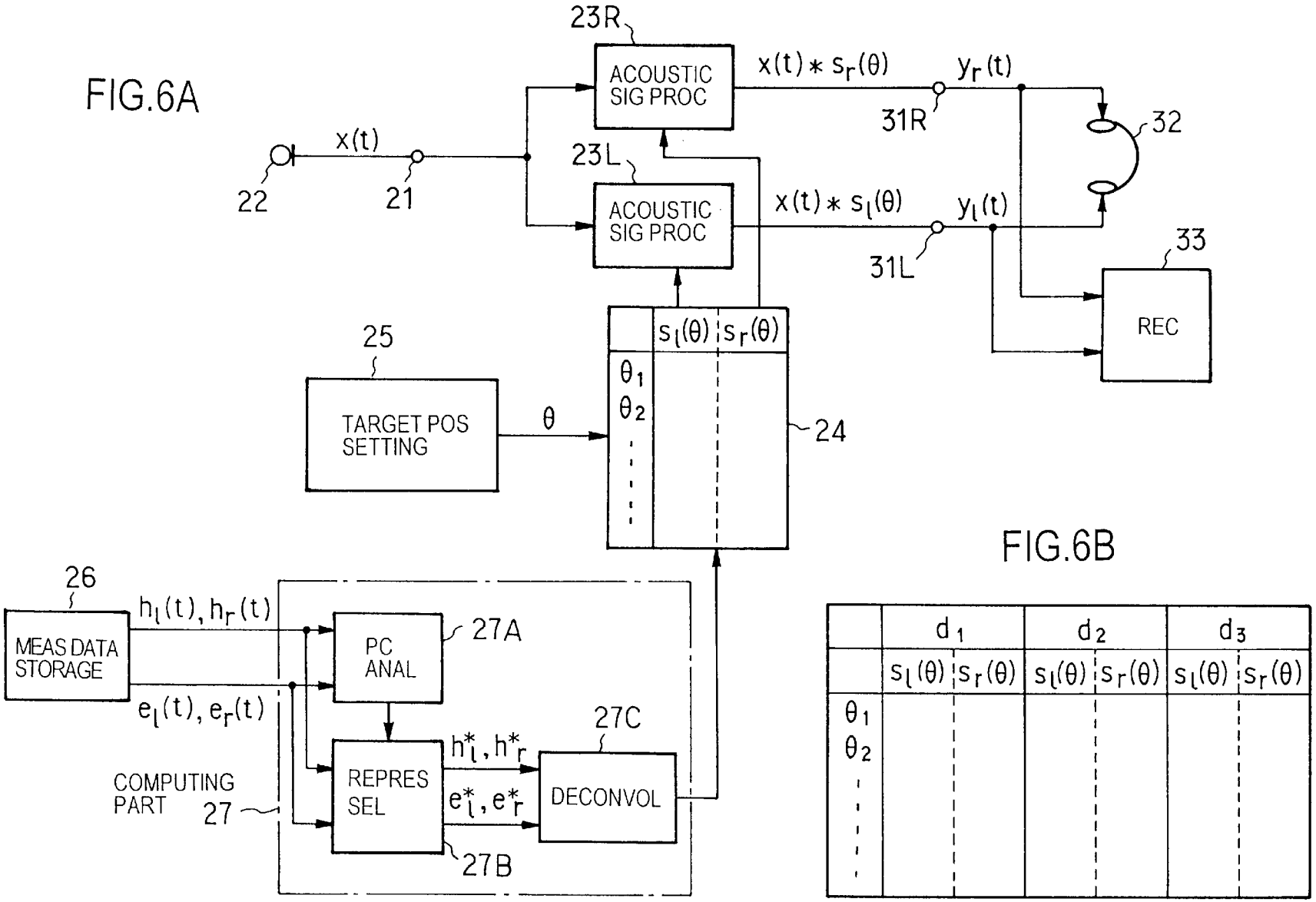
FIG. 6A is a functional block diagram for constructing an acoustic transfer function table for virtual sound localization for a reproducing system using headphones according to the present invention and for processing the acoustic signal using the transfer function table.
FIG. 6B illustrates another example of the acoustic transfer function table for virtual sound localization.

Construction of Acoustic Transfer Function Table and Acoustic Signal Processing Using the Same FIG. 6A shows a block diagram for the construction of the acoustic transfer function table according to the present invention and for processing an input acoustic signal through the use of the table. In a measured data storage part 26 there are stored data $h_l(k,\theta,d)$, $h_r(k,\theta,d)$ and $e_l(k)$, $e_r(k)$ measured for left and right ears of subjects with different sound source locations $(\theta,d)$. A computing part 27 is composed of a principal components analysis part 27A, a representative selection part 27B and a deconvolution part 27C. The principal components analysis part 27A conducts a principal component analysis of each of the stored head related transfer functions $h_l(t)$, $h_r(t)$ and ear canal transfer functions $e_l(t)$, $e_r(t)$, determines principal components of frequency characteristics at an accumulated contribution over a predetermined value (90%, for instance), and obtains from the analysis results weighting vectors of reduced dimensional numbers.

The representative selection part 27B calculates, for each pair of the target position θ and left or right ear (hereinafter identified by (θ, ear)), the distances D between the centroid $<w_z>$ and weighting vector obtained from each of all the subjects, and selects, as the representative $h^*_k(t)$, the head related transfer function $h_k(t)$ corresponding to the weighting vector $w_k$ that provides the minimum distance. Similarly, weighting vectors for the ear canal transfer function are used to obtain their centroids for both ears, and the ear canal transfer function corresponding to the weighting vector which is the closest to the centroid are selected as the representatives $e^*_l$ and $e^*_r$.

The deconvolution part 27C deconvolves the representative of head related transfer functions $h^*(\theta)$ for each pair (θ, ear) with the representative of ear canal transfer functions $e^*_l$ and $e^*_r$ to obtain sound localization transfer functions $s_l(\theta)$ and $s_r(\theta)$,respectively, which are to be written into a storage part 24. Hence, transfer functions $s_r(\theta,d)$ and $s_l(\theta,d)$ corresponding to each target position (θ,d) are determined from the data stored in the measured data storage part 26. They are written as a table into the acoustic transfer function table storage part 24. In this embodiment, however, only the sound source direction θ is controlled and the distance d is assumed to be constant, for the sake of simplicity. Accordingly, in the processing of an acoustic signal x(t) from a microphone 22 or a different acoustic signal source, not shown, a signal which specifies a desired target position (direction) to be set is applied from a target position setting part 25 to the transfer function table storage part 24, from which the corresponding sound localization transfer functions $s_l(\theta)$ and $s_r(\theta)$ are read out and are set in acoustic signal processing parts 23R and 23L. The acoustic signal processing parts 23R and 23L convolve the input acoustic signal x(t) with the transfer functions $s_l(\theta)$ and $s_r(\theta)$, respectively, and output the convolved signals $x(t)*s_l(\theta)$ and $x(t)*s_r(\theta)$ as acoustically processed signals $y_l(t)$ and $y_r(t)$ to terminals 31L and 31R. Reproducing the obtained output acoustic signals $y_l(t)$ and $y_r(t)$ through headsets 32, for instance, enables the listener to localize the sound image at the target position (direction) θ. The output signals $y_l(t)$ and $y_r(t)$ may also be provided to a recording part 33 for recording on a CD, MD, or cassette tape.

Figure 7:
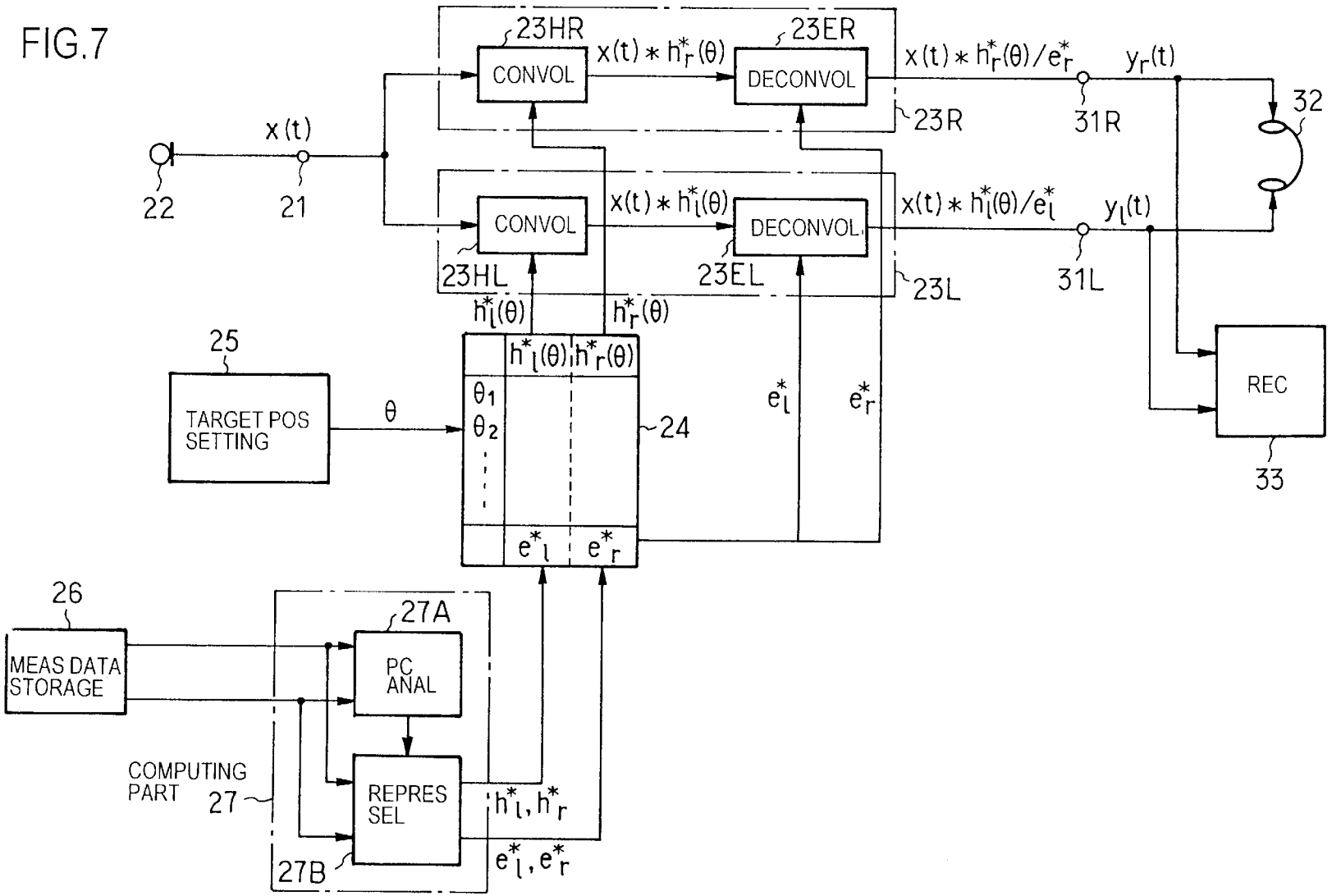
FIG. 7 is a functional block diagram for constructing an acoustic transfer function table for virtual sound localization for another reproducing system using headphones according to the present invention and for processing the acoustic signal using the transfer function table.

FIG. 7 illustrates a modification of the FIG. 6A embodiment, in which the acoustic signal processing parts 23R and 23L perform the convolution with the head related transfer functions $h_l(\theta)$ and $h_r(\theta)$ and deconvolution with the ear canal transfer functions $e_l$ and $e_r$ separately of each other. In this instance, the acoustic transfer function table storage part 24 stores, as a table corresponding to each azimuth direction θ, the representatives $h_r(\theta)$ and $h_l(\theta)$ of the head related transfer functions determined by the computing part 27 according to the method of the present invention. Accordingly, the computing part 27 is identical in construction with the computing part in FIG. 6A with the deconvolution part 27C removed therefrom. The acoustic signal processing parts 23R and 23L comprise a pair of the convolution part 23HR and deconvolution part 23ER and a pair of the head related transfer function convolving part 23HL and deconvolution part 23EL, respectively, and the head related transfer functions $h_r(\theta)$ and $h_l(\theta)$ corresponding to the designated azimuthal direction θ are read out of the transfer function table storage part 24 and set in the convolution parts 23HR and 23HL. The deconvolution parts 23ER and 23EL always read therein the ear canal transfer function representatives $e_r$ and $e_l$ and deconvolve the convolved outputs $x(t)*h_r(\theta)$ and $x(t)*h_l(\theta)$ from the convolution parts 23HR and 23HL with the representatives $e_r$ and $e_l$, respectively. Therefore, as is evident from Eqs. (3a) and (3b), the outputs from the deconvolution parts 23HR and 23HL are eventually identical to the outputs $x(t)*s_l(\theta)$ and $x(t)*s_r(\theta)$ from the acoustic signal processing parts 23R and 23L in FIG. 6A. Other constructions and operations of this embodiment are the same as those in FIG. 6A.

Figure 3:
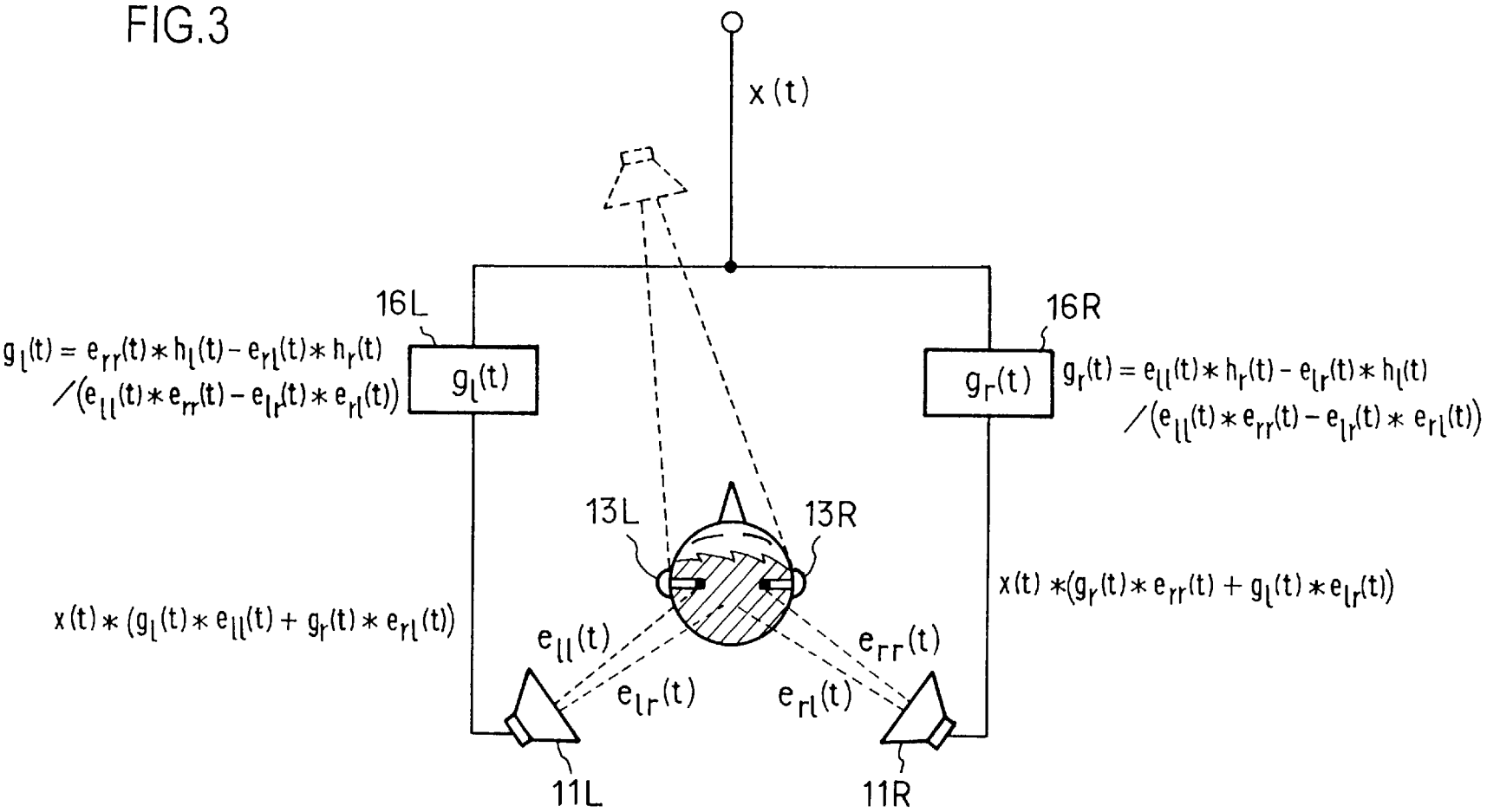
FIG. 3 is a diagram for explaining a scheme for implementing virtual sound localization in a sound reproduction system using a pair of loudspeakers.
Figure 8:
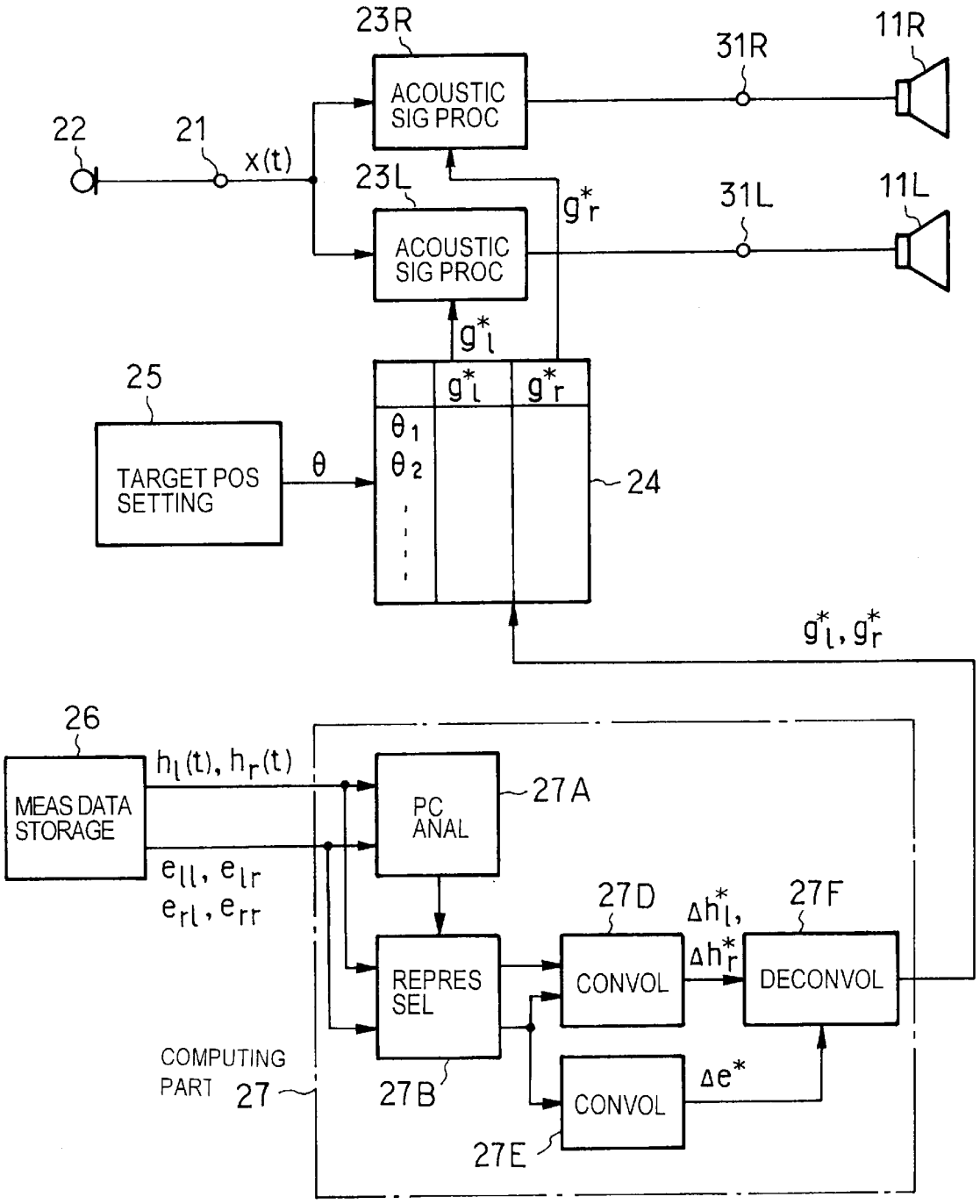
FIG. 8 is a functional block diagram for constructing an acoustic transfer function table for virtual sound localization for a reproducing system using a pair of loudspeakers according to the present invention and for processing the acoustic signal using the transfer function table.

FIG. 8 illustrates an example of the configuration wherein acoustic signals in a sound reproducing system using two loudspeakers 11R and 11L as in FIG. 3 are convolved with set transfer functions $g(\theta)$ and $g_l(\theta)$ read out of the acoustic transfer table storage part 24, and depicts a functional block configuration for construction of the acoustic transfer function table for virtual sound localization. Since this reproduction system requires the transfer functions $g_r(\theta)$ and $g_l(\theta)$ given by Eqs. (5a) and (5b), transfer functions $g^*_r(\theta)$ and $g^*_l(\theta)$ corresponding to each target position θ are written in the transfer function table storage part 24 as a table. The principal components analysis part 27A of the computing part 27 analyzes principal components of the head related transfer functions $h_r(t)$ and $h_l(t)$ stored in the measured data storage part 26 and sound source-eardrum transfer functions $e_{rr}$, $e_{rl}$, $e_{lr}$ and $e_{ll}$ according to the method of the present invention. Based on the results of analysis, the representative selecting part 27B selects, for each pair (θ, ear) of target direction θ and ear (left, right), the head related transfer functions $h_r(t)$, $h_l(t)$ and the sound source-eardrum transfer functions $e_{rr}$, $e_{rl}$, $e_{lr}$, $e_{ll}$ that provide the weight vectors closest to the centroids and sets them as representatives $h^*_r(\theta)$, $h^*_l(\theta)$, $e^*_{rr}$, $e^*_{rl}$, $e^*_{lr}$ and $e^*_{ll}$. A convolution part 27D performs the following calculations to obtain $\Delta h^*_r(\theta)$ and $\Delta h^*_l(\theta)$ from the representatives $h^*_r(\theta)$, $h^*_l(\theta)$ and $e^*_{rr}$, $e^*_{rl}$, $e^*_{rl}$, $e^*_{ll}$ corresponding to each azimuthal direction θ:

$$\Delta h^*_r(\theta)=\{e^*_{rr}.h^*_l(\theta)-e^*_{rl}.h^*_r(\theta)\} \text{ and}$$

$$\Delta h^*_l(\theta)=\{e^*_{ll}.h^*_r(\theta)-e^*_{lr}.h^*_l(\theta)\}$$

A convolution part 27E performs the following calculation to obtain $\Delta e^*$:

$$\Delta e^*=\{e^*_{ll}.e_{rr}-e^*_{lr}.e^*_{rl}\}$$

A deconvolution part 27F calculates transfer functions $g_r^*(\theta)$ and $g_l^*(\theta)$ by deconvolutions $g_r^*(\theta)=\Delta h^*_r/\Delta e^*$ and $g_l^*(\theta)=\Delta h^*_l/\Delta e^*$ and writes them into the transfer function table storage part 24.

Figure 9:
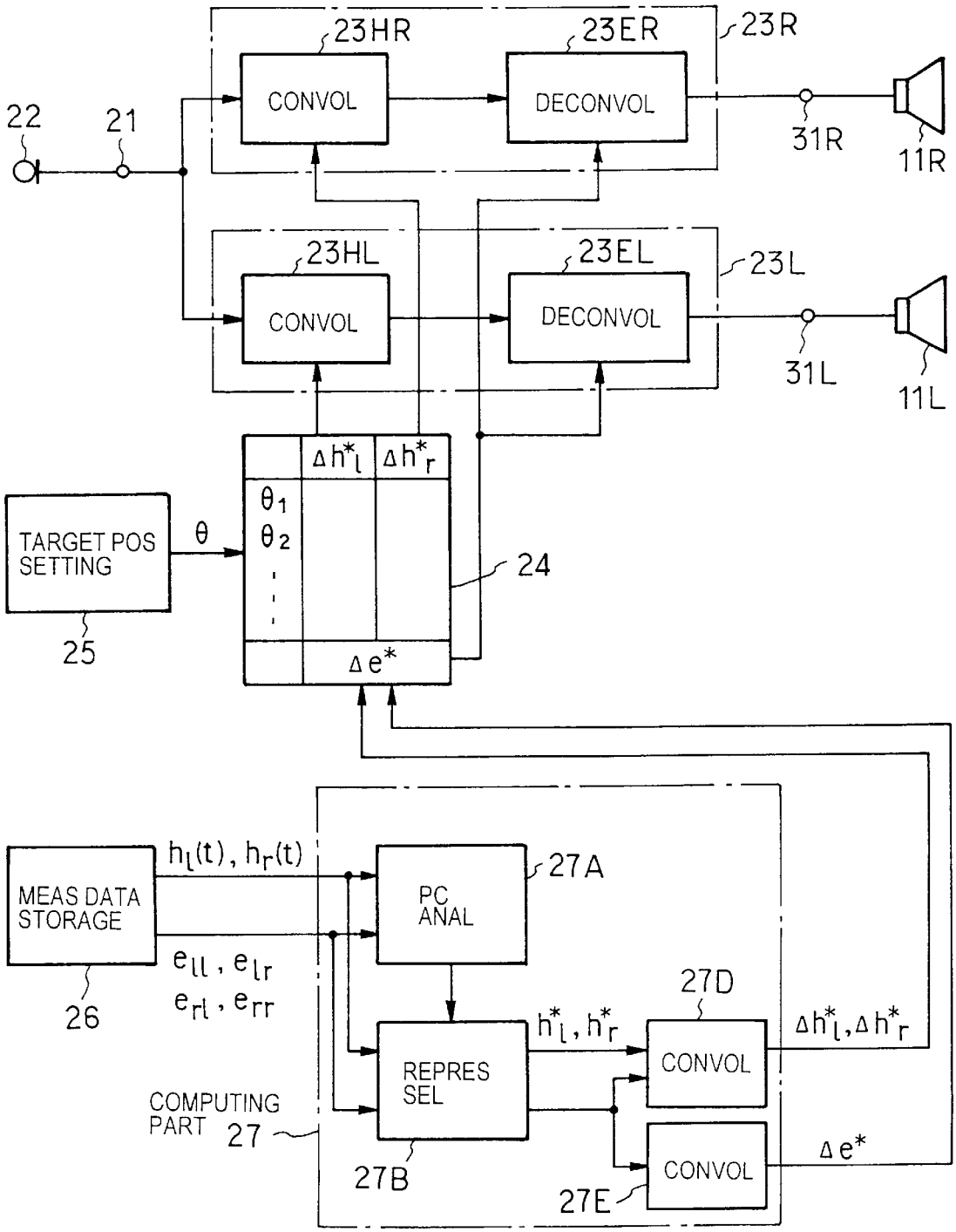
FIG. 9 is a functional block diagram for constructing an acoustic transfer function table for virtual sound localization for another reproducing system using a pair of loudspeakers according to the present invention and for processing the acoustic signal using the transfer function table.

FIG. 9 illustrates in block form an example of the configuration which performs deconvolutions in Eqs. (5a) and (5b) by the reproducing system as in the FIG. 7 embodiment, instead of performing the deconvolutions in Eqs. (5a) and (5b) by the deconvolution part 27F in the FIG. 8 embodiment. That is, the convolution parts 23HR and 23HL convolve the input acoustic signal x(t), respectively, as follows:

$$\Delta h^*_l(\theta)=\{e_{ll}(\theta)*h_r(\theta)-e_{lr}(\theta)*h_l(\theta)\} \text{ and}$$

$$\Delta h^*_r(\theta)=\{e_{rr}(\theta)*h_l(\theta)-e_{rl}(\theta)*h_r(\theta)\}$$

The deconvolution parts 23ER and 23EL respectively deconvolve the outputs from the convolution parts 23HR and 23HL by $$\Delta e^*=\{e_{ll}(\theta)*e_{rr}(\theta)-e_{lr}(\theta)*e_{rl}(\theta)\}$$

The deconvolved outputs are fed as edited acoustic signals $y_r(t)$ and $y_l(t)$ to the loudspeakers 11R and 11L, respectively.

Accordingly, the transfer function table storage part 24 in this embodiment stores, as a table, $\Delta e^*$ and $\Delta h^*_r(\theta)$, $\Delta h^*_l(\theta)$ corresponding to each target position θ. In the computing part 27 that constructs the transfer function table, as is the case with the FIG. 8 embodiment, the results of analysis by the principal components analysis part 27A are used to determine the sound source-eardrum transfer functions $e_{rr}$, $e_{rl}$, $e_{lr}$ and $e_{ll}$ selected by the representative selection part 27B, as the representatives $e_{rr}$, $e^*_{rl}$, $e^*_{lr}$ and $e^*_{ll}$, and determines $h_r(\theta)$ and $h_l(\theta)$ selected for each target position, as the representatives $h^*_r(\theta)$ and $h^*_l(\theta)$. In this embodiment the convolution part 27D uses thus determined representatives to further conduct the following calculations for each target position θ:

$$\Delta h^*_r(\theta)=\{e^*_{rr}.h_l(\theta)-e^*_{rl}.h_r(\theta)\} \text{ and}$$

$$\Delta h^*_l(\theta)=\{e^*_{ll}.h_r(\theta)-e^*_{lr}.h_l(\theta)\}$$

Then the convolution part 27E conducts the following calculation:

$$\Delta e^*=\{e^*_{ll}{}^*e^*_{rr}-e^*_{lr}.e^*_{rl}\}$$

These outputs are written into the transfer function table storage part 24.

In the embodiments of FIGS. 8 and 9, when the sound source-eardrum transfer functions $e_{rl}$ and $e_{lr}$ of mutually intersecting paths from the loudspeakers to the respective ears are negligible, it is possible to utilize the same configuration as that of the FIG. 6 embodiment. In such an instance, the ear canal transfer functions $e_r(t)$ and $r_l(t)$ are substituted with the sound source-eardrum transfer functions $e_{rr}$ and $e_{ll}$ corresponding to the paths between the loudspeakers and listeners ears directly facing each other. Such an example corresponds to the case where the speakers are each placed adjacent to one of the listener's ears.

In the embodiments of FIGS. 6A, 8 and 9 the measured acoustic transfer functions are subjected to the principal components analysis and the representatives are determined based on the results of analysis, after which the deconvolutions (FIG. 6A) and the convolutions and deconvolutions (FIGS. 8 and 9) are carried out in parallel. However, the determination of the representatives based on the principal components analysis may also be performed after these deconvolution and/or convolution.

Figure 10:
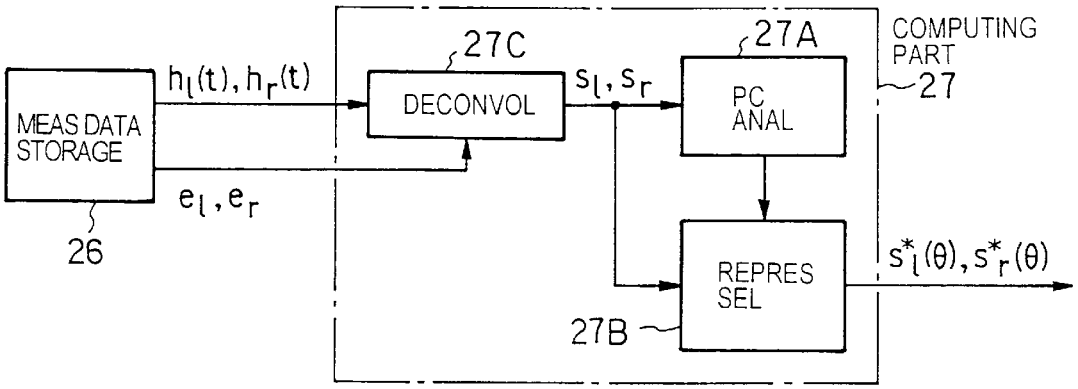
FIG. 10 illustrates a block diagram of a modified form of a computing part 27 in FIG. 6A.

For example, as shown in FIG. 10, the deconvolution part 27C in FIG. 6A is disposed at the input side of the principal components analysis part 27A, by which measured head related transfer functions $h_r(t)$ and $h_l(t)$ are all deconvolved using the ear canal transfer functions $e_r$ and $e_l$, respectively, then all the sound localization transfer functions $s_r(t)$ and $S_l(t)$ thus obtained are subjected to the principal components analysis, and representatives $s^*_r(\theta)$ and $s^*_l(\theta)$ are determined based on the results of the principal components analysis.

Figure 11:
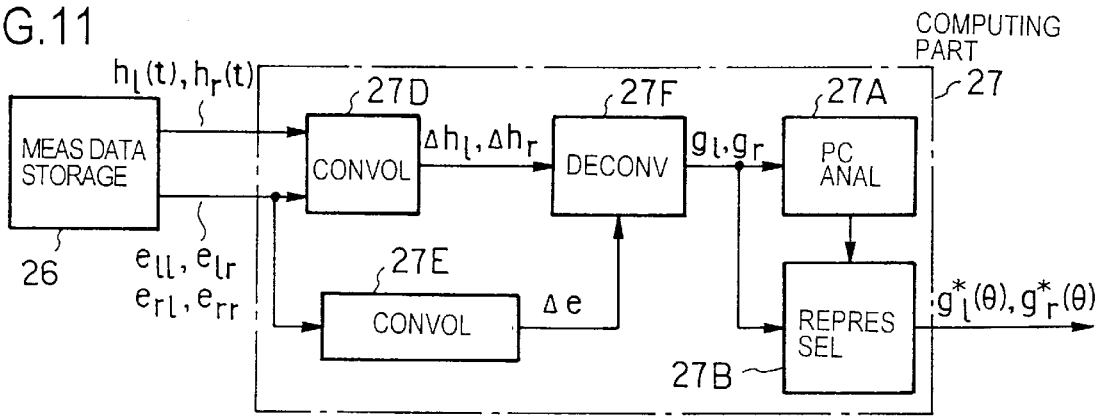
FIG. 11 is a block diagram illustrating a modified form of a computing part 27 in FIG. 8.

It is also possible to employ such a configuration as shown in FIG. 11, in which the convolution parts 27D and 27E and the deconvolution part 27F in the FIG. 8 embodiment are provided at the input side of the principal components analysis part 27A and the transfer functions g. and g, are calculated by Eqs. (5a) and (5b) from all the measured head related transfer functions $h_r(t)$, $h_l(t)$ and the sound source-eardrum transfer functions $e_{rl}$, $e_{ll}$. The representatives $g^*_r(\theta)$ and $g^*_l(\theta)$ can be determined based on the results of principal components analysis of the transfer functions $g_r$ and $g_l$.

Figure 12:
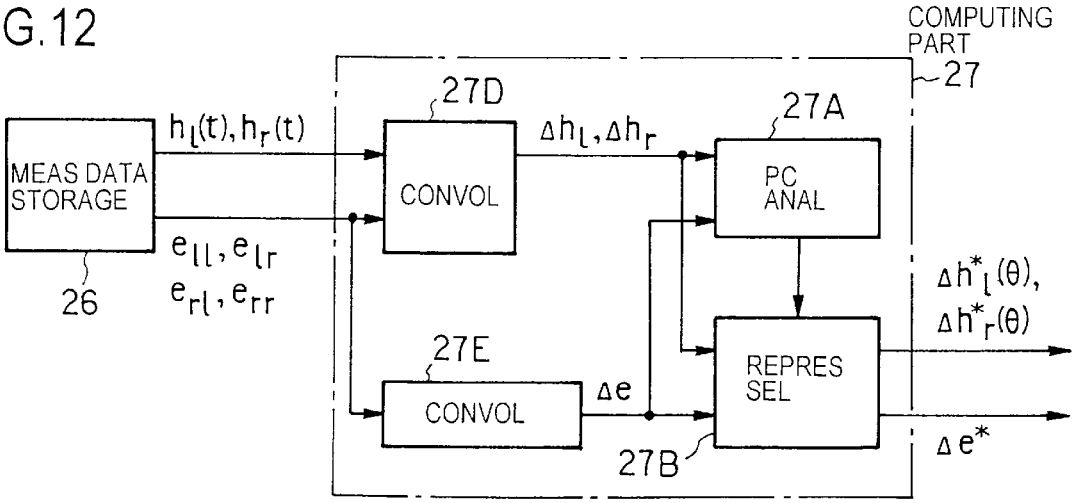
FIG. 12 is a block diagram illustrating a modified form of a computing part 27 in FIG. 9.

Also it is possible to utilize such a configuration as depicted in FIG. 12 in which the convolution parts 27D and 27E in the FIG. 9 embodiment are provided at the input side of the principal components analysis part 27A and $\Delta h_r(\theta)$, $\Delta h_l(\theta)$ and $\Delta e$ in Eqs. (5a) and (5b) are calculated from all the measured head related transfer functions $h_r(\theta)$, $h_l(\theta)$ and the sound source-eardrum transfer functions $e_{rl}$, $e_{ll}$. They are subjected to the principal components analysis and the representatives $\Delta h^*_r(\theta)$, $\Delta h^*_l(\theta)$ and $\Delta e^*$ are determined accordingly.

Transfer Function Table Constructing Method

Figure 13:
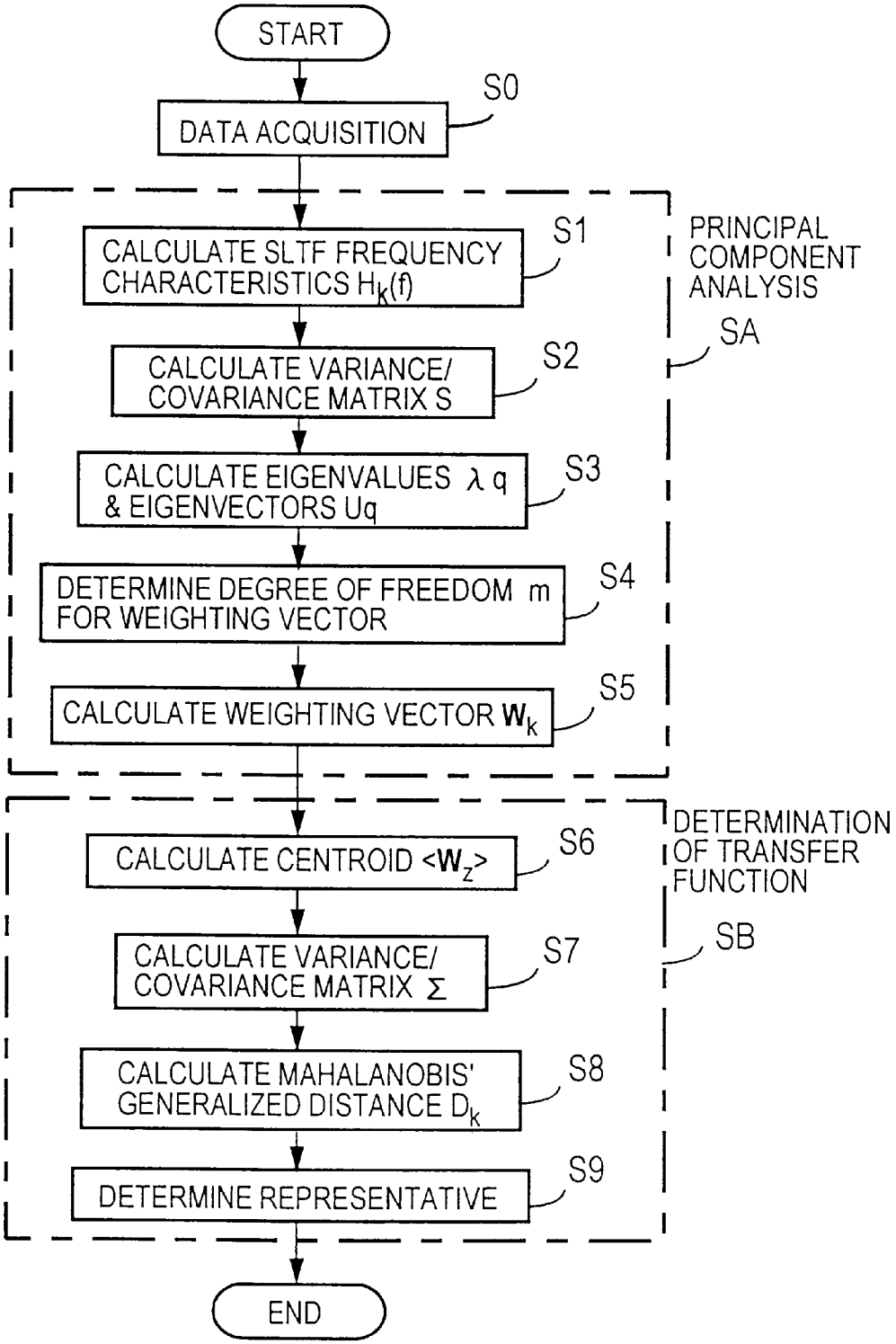
FIG. 13 shows a flow chart of procedure for constructing the acoustic transfer function table for virtual sound localization according to present invention.

FIG. 13 shows the procedure of an embodiment of the virtual acoustic transfer function table constructing method according to the present invention. This embodiment uses the Mahalanobis' generalized distance as the distance between the weighting vector of the amplitude-frequency characteristics of the acoustic transfer function and the centroid vector thereof. A description will be given, with reference to FIG. 13, of a method for selecting the acoustic transfer functions according to the present invention.

Step S0: Data Acquisition

Figure 1A:
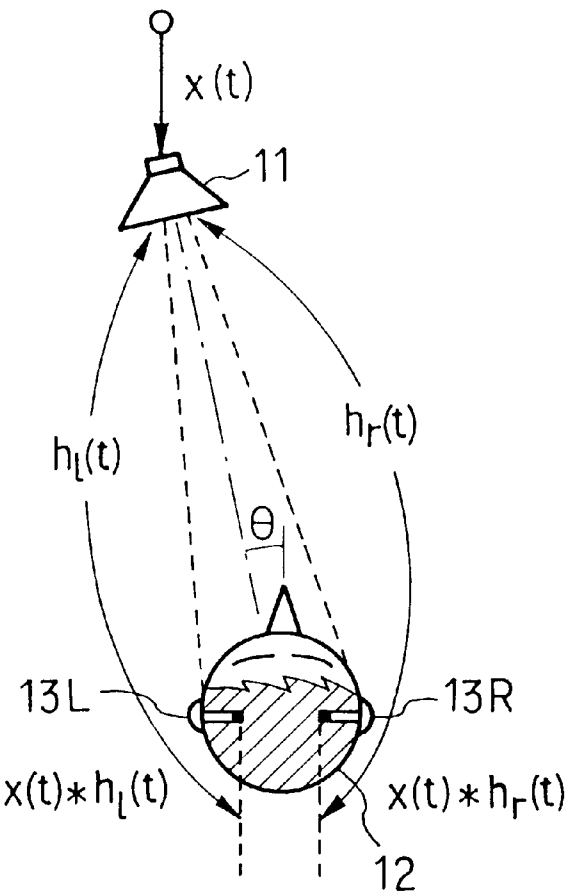
FIG. 1A is a diagram for explaining acoustic transfer functions (head related transfer functions) from a sound source to left and right eardrums of a listener.
Figure 14:
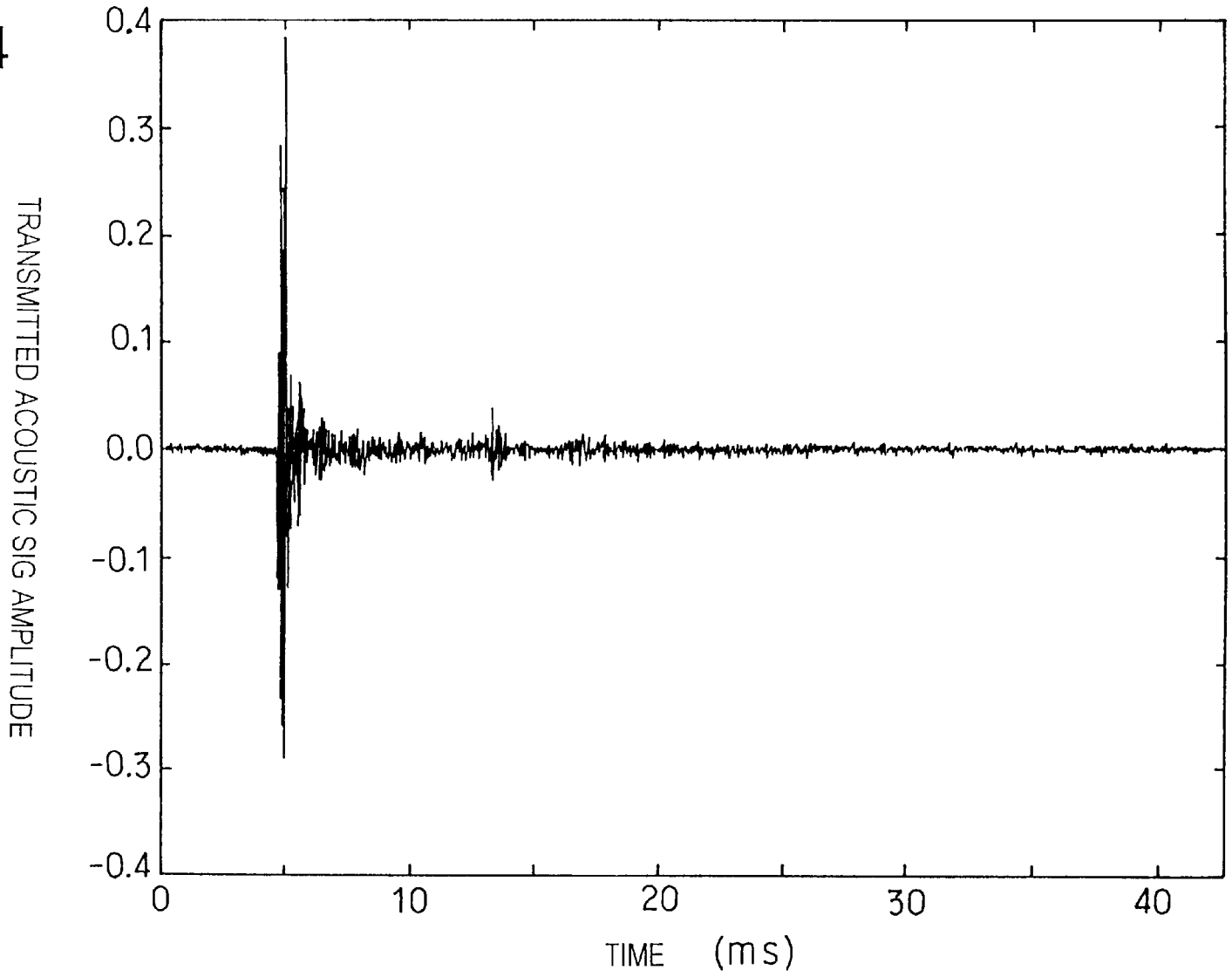
FIG. 14 shows an example of a temporal sequence of a sound localization transfer function.

To construct an acoustic transfer function table with which enables the majority of potential listeners to localize a sound at a target position, the sound localization transfer functions of Eqs. (3a) and (3b) or (3a') and (3b') from the sound source 11 to left and right ears of 57 subjects, for example, under the reproduction system of FIG. 1A are measured. To this end, for example, 24 locations for the sound source 11 are predetermined on a circular arc of a 1.5-m radius centering at the subject 12 at intervals of 15° over an angular range θ from −180° to +180°. The sound source 11 is placed at each of the 24 locations and the head related transfer functions $h_l(t)$ and $h_r(t)$ are measured for each subject. In the case of measuring the transfer functions $s_l(t)$ and $s_r(t)$ according to Eqs. (3A') and (3b'), the output characteristic $s_p(t)$ of each sound source (loudspeaker) 11 should also be measured in advance. For instance, the numbers of coefficients composing the sound localization transfer functions $s_l(t)$ and $s_r(t)$ are each set at 2048. The transfer functions are measured as the impulse response to the input sound source signal x(t) sampled at a frequency of 48.0 kHz. By this, 57 by 24 pairs of head related transfer functions $h_l(t)$ and $h_r(t)$ are obtained. The ear canal transfer functions $e_l(t)$ and $e_r(t)$ are measured only once for each subject. These data can be used to obtain 57 by 24 pairs of sound localization transfer functions $s_l(t)$ and $s_r(t)$ by Eqs. (3a) and (3b) or (3a') and (3b'). FIG. 14 shows an example of the sound localization transfer functions thus obtained.

Step SA: Principal Components Analysis

Figure 15:
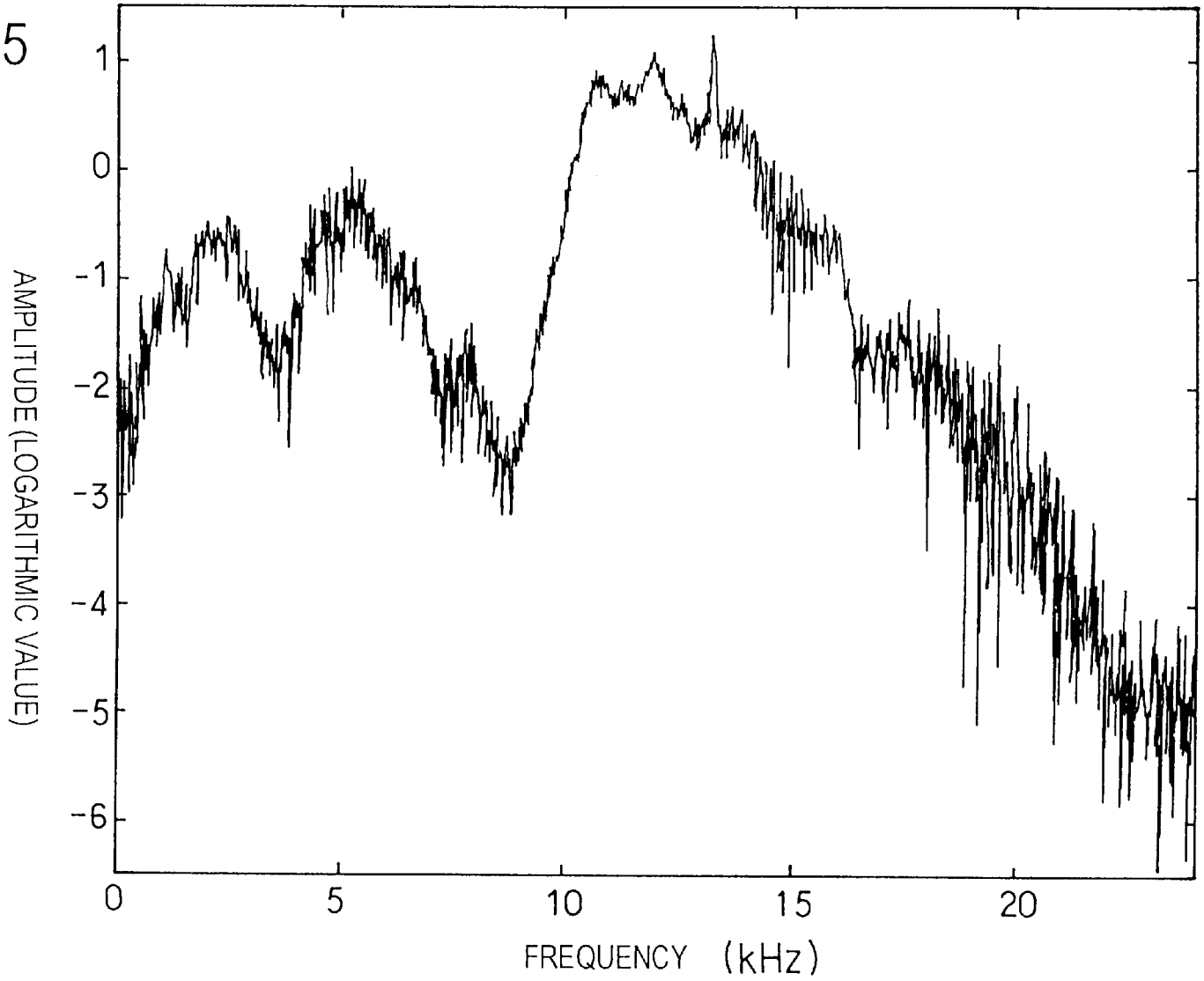
FIG. 15 shows an example of an amplitude of a sound localization transfer function as a function of frequency.

Step S1: In the first place, a total of 2736 (57 subjects by two ears (right and left) by 24 sound source locations) are subjected to Fast Fourier Transform (FFT). Amplitude-frequency characteristics $H_k(f)$ are obtained as the logarithms of absolute values of the transformed results. An example of the amplitude-frequency characteristics of the sound localization transfer functions is shown in FIG. 15. According to the Nyquist's sampling theorem, it is possible to express frequency components up to 24.0 kHz, one-half the 48.0-kHz sampling frequency. However, the frequency band of sound waves that the sound source 11 for measurement can stably generate is 0.2 to 15.0 kHz. For this reason, amplitude-frequency characteristics corresponding to the frequency band of 0.2 to 15.0 kHz are used as characteristic values. By dividing the sampling frequency $f_s$=48.0 kHz by the number $n_0$=2048 of coefficients forming the sound localization transfer functions, frequency resolution Δf (about 23.4 Hz) can be obtained. Hence, the characteristic value corresponding to each sound localization transfer function is composed of a vector of p=632 dimensions.

Step S2: Next, the variance/covariance matrix S is calculated following Eq. (6). Because of the size of the characteristic value vector, the size of the variance/covariance matrix is 632 by 632.

Step S3: Next, eigenvalues λq and eigenvectors (principal component vectors) $u_q$ of the variance/covariance matrix S which satisfy Eq. (7) are calculated. The order q of the variance/covariance matrix S is determined in a descending order of the eigenvalues $\lambda_q$ as in Eq. (8).

Figure 16:
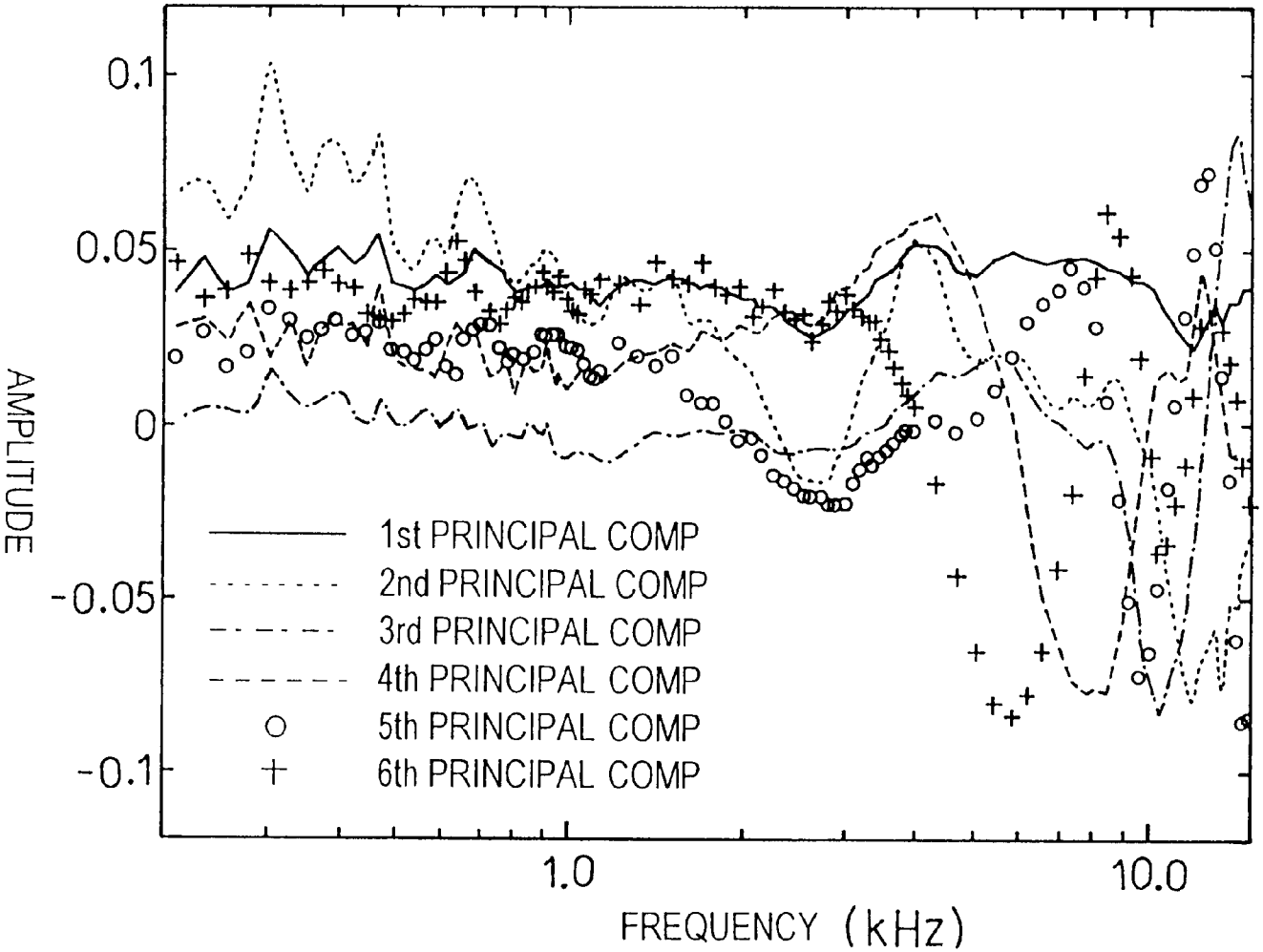
FIG. 16 shows frequency characteristics of principal components.
Figure 17B:
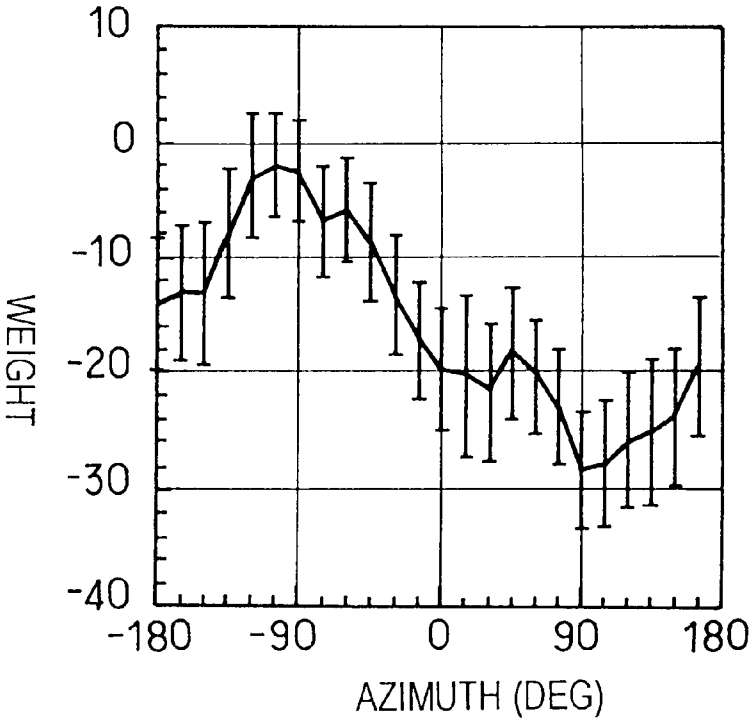
FIG. 17B shows the weight of the second principal component contributing to the acoustic transfer function measured at a listener's left ear as a function of azimuth.
Figure 17A:
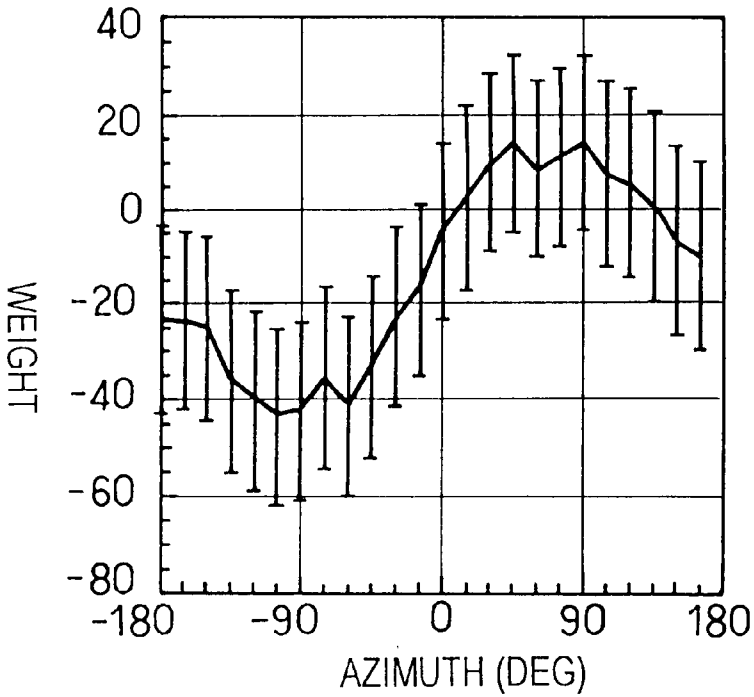
FIG. 17A shows the weight of the first principal component contributing to the acoustic transfer function measured at a listener's left ear as a function of azimuth.
Figure 18B:
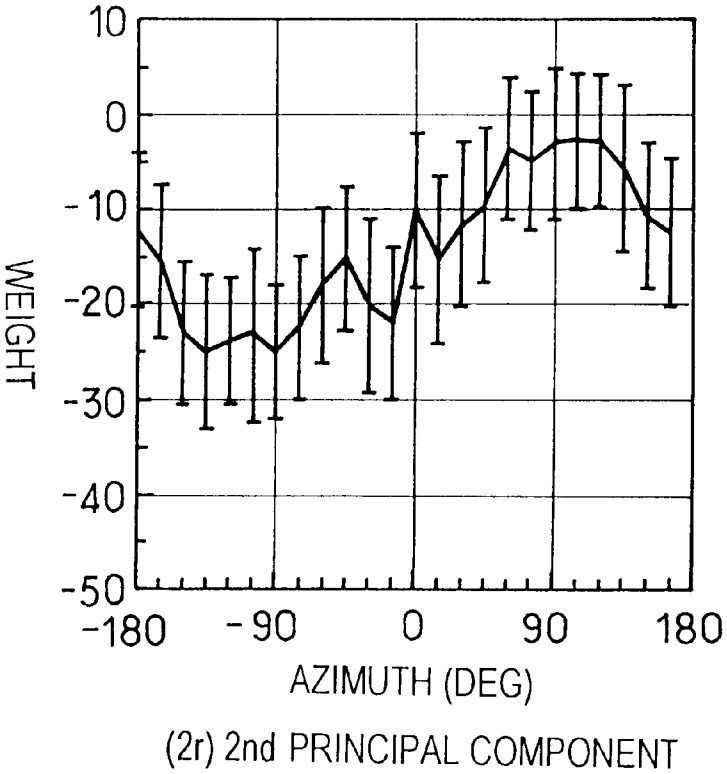
FIG. 18B shows the weight of the second principal component contributing to the acoustic transfer function measured at a listener's right ear.
Figure 18A:
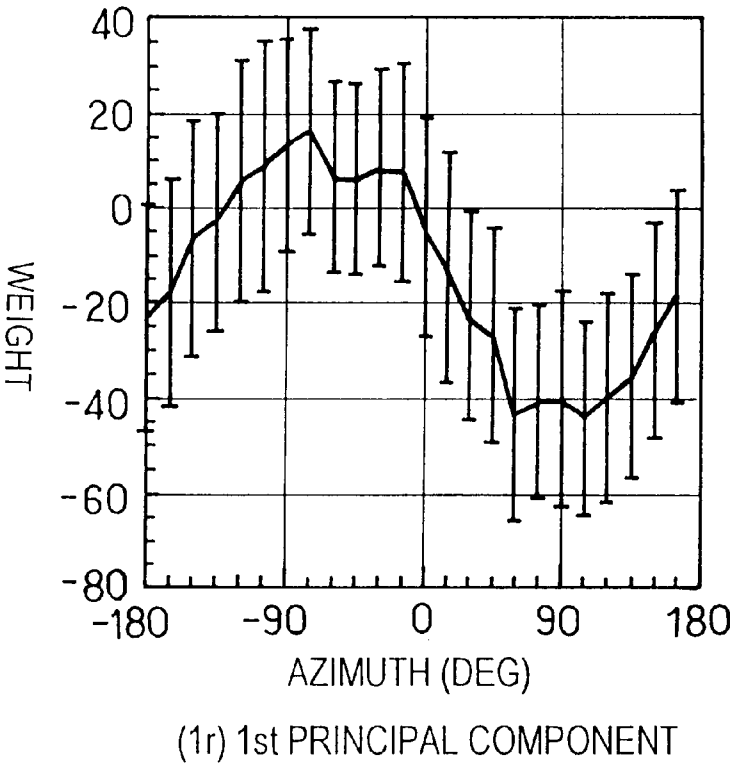
FIG. 18A shows the weight of the first principal component contributing to the acoustic transfer function measured at a listener's right ear.

Step S4: Next, accumulated contribution $P_m$ from first to m-th principal components is calculated in descending order of the eigenvalues $\lambda_q$ by using Eq. (10) to obtain the minimum number m that provides the accumulated contribution over 90%. In this embodiment, the accumulated contribution $P_m$ is 60.2, 80.3, 84.5, 86.9. 88.9 and 90.5% in descending order starting with the first principal component. Hence, the number of dimensions m of the weighting vectors $w_k$ is determined to be six. The frequency characteristics of the first to sixth principal components $u_q$ are shown in FIG. 16. Each principal component presents a distinctive frequency characteristics.

Step S5: Next, the amplitude-frequency characteristics of the sound localization transfer functions $s_l(t)$ and $s_r(t)$ obtained for each subject, for each ear and for each sound source direction are represented, following Eq. (11), by the weighting vector $w_k$ conjugate to respective principal component vectors $u_q$. Thus, the degree of freedom for representing the amplitude-frequency characteristics can be reduced from p(632) to m(=6). Here, the use of Eq. (12) will provide the centroid $<w_z>$ for each ear and for each sound source direction θ. FIGS. 17A, 17B and 18A, 18B respectively show centroid of weights conjugate to first and second principal components of the sound localization transfer functions measured at the left and right ears and standard deviations of the centroids. In this case, the azimuth e of the sound source was set to be counter-clockwise, with the source location in front of the subject set at 0°. According to an analysis of variance, the dependency of the weight on the sound source direction is significant (for each principal component an F value is obtained which has a significance level of $p<0.001$). That is, the weighting vector corresponding to the acoustic transfer function distributes over subjects but significantly differs with the sound source locations. As will be seen from comparison of FIGS. 17A, 17B and 18A, 18B, the sound source direction characteristic of the weight is almost bilaterally symmetrical for the sound localization transfer function measured for each ear.

Step SB: Representative Determination Processing

Step S6: The centroids $<w_z>$ of the weighting vectors $w_k$ over subjects (k) are calculated using Eq. (12) for each ear (right and left) and each sound source direction (θ).

Step S7: The variance/covariance matrix Σ of the weighting vectors $w_k$ over subjects is calculated according to Eq. (14) for each ear and each sound source direction θ.

Step S8: The Mahalanobis' generalized distance $D_k$ given by Eq. (13) is used as the distance between each weighting vector $w_k$ and the centroid $<w_z>$; the Mahalanobis' generalized distances $D_k$ between the weighting vectors $w_k$ of every subject and the centroid vector $<w_z>$ thereof are calculated for each ear and each target position θ.

Step S9: The head related transfer functions $h_k(t)$ corresponding to the weighting vectors $w_k$ for which the Mahalanobis' generalized distance $D_k$ is minimum are selected as the representatives and stored in the storage part 24 in FIG. 6A in correspondence with the ears and the sound source directions θ. In this way, the sound localization transfer functions selected for all the ears and sound source directions θ are obtained as representatives of the acoustic transfer functions.

Similarly, steps S1 to S9 are carried out also for the ear canal transfer functions $e_r$ and $e_l$ to determine a pair of ear canal transfer functions as representatives $e^*_r$ and $r^*_l$, which are stored in the storage part 24.

Figures 19, 20:
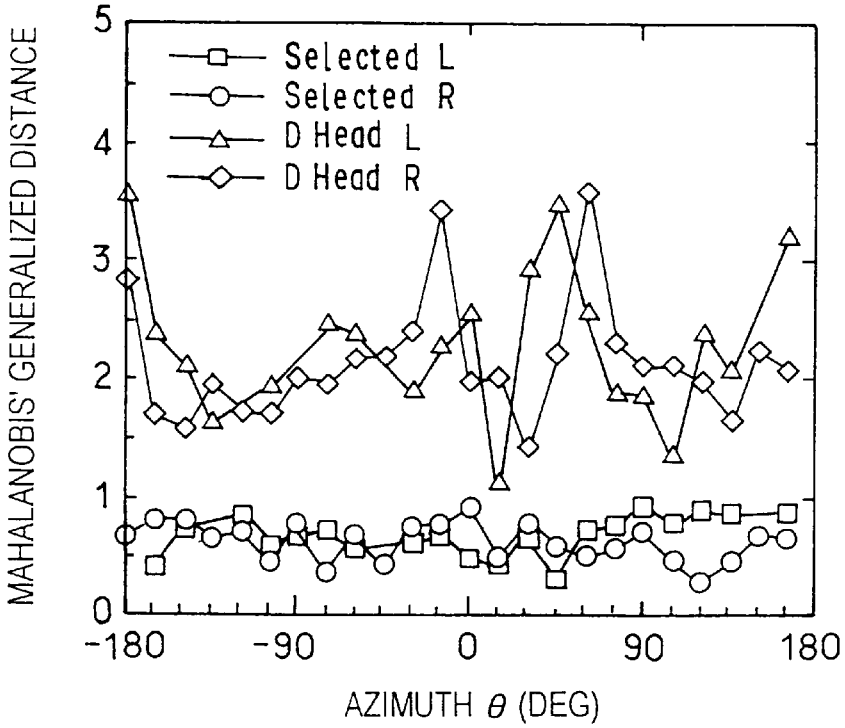
FIG. 19 shows Mahalanobis' generalized distance between the centroid and respective representatives.
FIG. 20 shows the subjects' number of selected sound localization transfer function.

FIG. 19 shows the Mahalanobis' generalized distances for the weighting vectors corresponding to the representatives of the sound localization transfer functions (Selected L/R) and for the weighting vectors corresponding to sound localization transfer functions by a dummy head (D Head L/R). The Mahalanobis' generalized distances for the representatives were all smaller than 1.0. The sound localization transfer functions by the dummy head were calculated using Eq. (11). In the calculation of the principal component vectors, however, the sound localization transfer functions by the dummy head were excluded. That is, the principal components vectors $u_q$ and the centroid vector $<w_z>$ were obtained for the 57 subjects. As seen from FIG. 19, the Mahalanobis' generalized distance for (D Head L/R) by the dummy head was typically 2.0 or so, 3.66 at maximum and 1.21 at minimum.

FIG. 20 shows the subject numbers (1~57) of the selected sound localization transfer functions. It appears from FIG. 20 that the same subject is not always selected for all the sound source directions θ or for the same ear.

The distribution of squared values $D^2$ of the Mahalanobis' generalized distances for the acoustic transfer functions measured using the human head can be approximated to a χ-square distribution with six degrees of freedom as shown in FIG. 4. An analysis is made of the results of approximation using the accumulated distribution $P(D^2)$:

$$P(D^2)=\int_0^{D^2}\chi_6^2(t)dt \tag{16}$$

By using the above Mahalanobis' generalized distance, $P(1.0^2)=0.0144$, $P(1.21^2)=0.0378$, $P(2.0^2)=0.3233$ and $P(3.66^2)=0.9584$ are obtainable. That is, it can be said that the amplitude-frequency characteristics of the sound localization transfer functions by the dummy head deviate much more than those by a number of listeners. In other words, the acoustic transfer functions selected according to the present invention are more approximate to the amplitude-frequency characteristics by the majority of potential listeners than the acoustic transfer functions by the dummy head conventionally used as representatives. With the use of the acoustic transfer function table thus constructed according to the present invention, it is possible to make an unspecified number of listeners localize in target sound source direction (on a circular arc of a radius d=1.5 m around the listener in the above-described example). Although in the above the acoustic transfer function table is constructed with the sound sources 11 placed on the circular arc of the 1.5-m radius centering at the listener, the acoustic transfer functions can be classified according to radius d as well as for each sound source direction θ as shown in FIG. 6, by similarly measuring the acoustic transfer functions with the sound sources 11 placed on circular arcs of other radii $d_2$, $d_3$, . . . and selecting the acoustic transfer functions following the procedure of FIG. 13. This provides a cue to control the position for sound localization in the radial direction.

As an example of the above-described acoustic transfer function table making method, the acoustic transfer function from one sound source position to one ear and the acoustic transfer function from a sound source position at an azimuth laterally symmetrical to the above-said source position to the other ear are regarded as approximately the same and are determined to be identical. For example, the selected acoustic transfer functions from a sound source location of an azimuth of 30° to the left ear are adopted also as the acoustic transfer functions from a sound source location of an azimuth of −30° to the right ear in step S9. The effectiveness of this method is based on the fact that, as shown in FIGS. 17A, 17B and 18A, 18B, the sound localization transfer functions $h_l(t)$ and $h_r(t)$ measured in the left and right ears provide centroids substantially laterally symmetrical to the azimuth θ of the sound source. According to this method, the number of acoustic transfer functions h(t) to be selected is reduced by half, so that the time for measuring all the acoustic transfer functions h(t) and the time for making the table can be shortened and the amount of information necessary for storing the selected acoustic transfer functions can be cut by half.

In the transfer function table making procedure described previously with reference to FIGS. 6A and 13, the respective frequency characteristic values obtained by the Fast Fourier transform of all the measured head related transfer functions $h_l(t)$, $h_r(t)$ and $e_l(t)$, $e_r(t)$ in step S1 are subjected to the principal components analysis. But it is also possible to use the sound localization transfer functions $s_l(t)$ and $s_r(t)$ obtained in advance by Eqs. (3a) and (3b), using all the measured head related transfer functions $h_1(t)$, $h_r(t)$ and ear canal transfer functions $e_l(t)$, $e_r(t)$. In this instance, the sound localization transfer functions $s_l(t)$ and $s_r(t)$ are subjected to the principal components analysis, following the same procedure as in FIG. 13, to determine the representatives $s^*_l(t)$ and $s^*_r(t)$, which is used to make the transfer function table. In the case of the two-loudspeaker reproduction system (transaural) of FIG. 3, it is also possible to employ such a method as shown in FIG. 11 wherein the transfer functions $g_l(t)$ and $g_r(t)$ given by (5a) and (5b) are pre-calculated from the measured data $h_l(t)$, $h_r(t)$, $e_{rr}(t)$, $e_{rl}(t)$, $e_{lr}(t)$ and $e_{ll}(t)$ and the transfer functions $g_l(t)$ and $g_r(t)$ are subjected to the principal components analysis to obtain the representatives $g^*_l(t)$ and $g^*_r(t)$ for storage as the transfer function table. In the case of FIG. 9, as depicted in FIG. 12, the coefficients $\Delta h_r(t)$, $\Delta h_l(t)$ and $\Delta e(t)$ of Eqs. (5a) and (5b) are pre-calculated from the measured data $h_l(t)$, $h_r(t)$, $e_{rr}(t)$, $e_{rl}(t)$ $e_{lr}(t)$ and $e_{ll}(t)$ and the representatives $\Delta h^*_r(t)$, $\Delta h^*_l(t)$ and $\Delta e^*$ selected from the pre-calculated coefficients are used to make the transfer function table.

Figure 21:
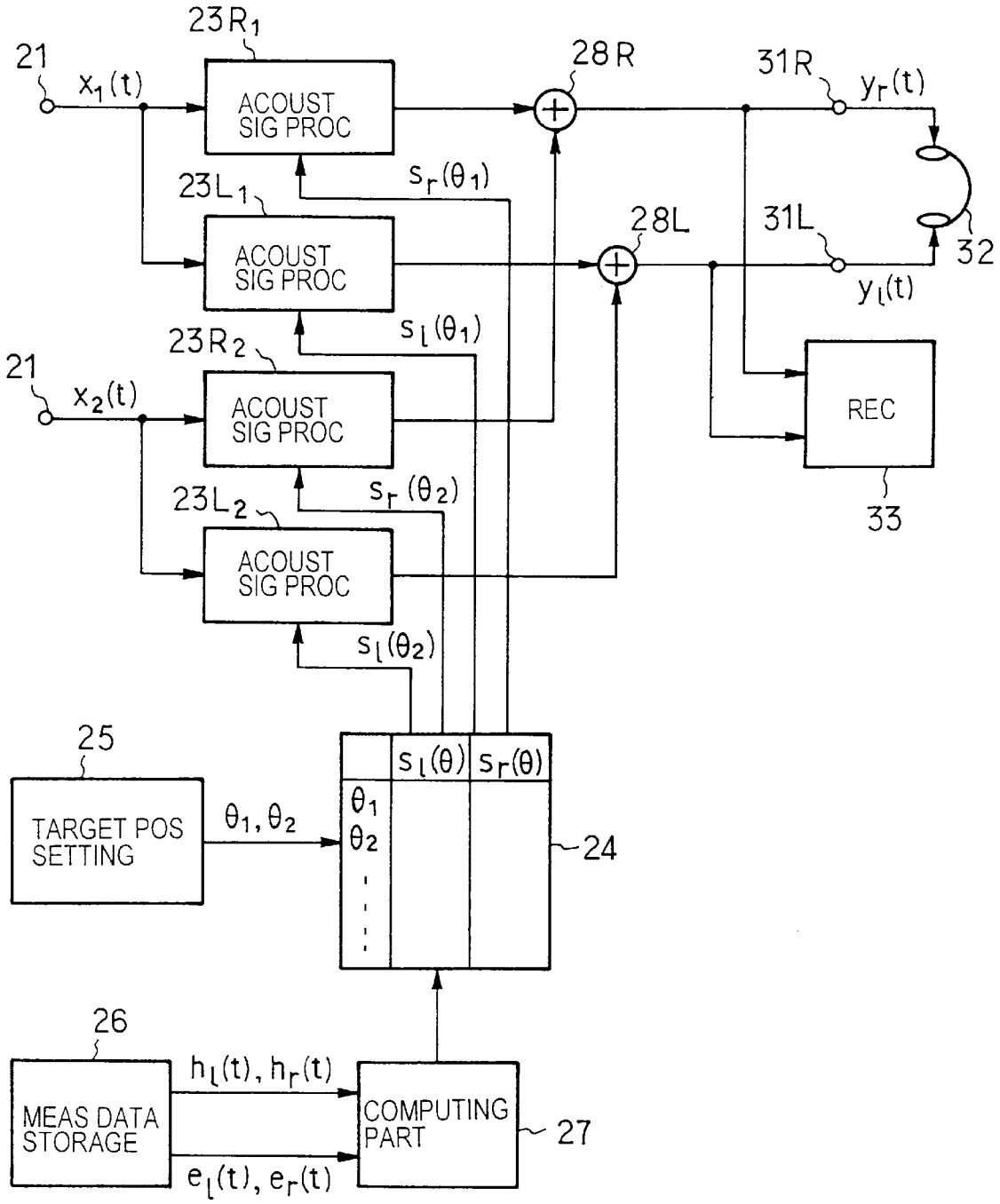
FIG. 21 illustrates a block diagram of a reproduction system employing the acoustic transfer function table of the present invention for processing two independent input signals of two routes.

FIG. 21 illustrates another embodiment of the acoustic signal editing system using the acoustic transfer function table for virtual sound localization use constructed as described above. FIGS. 6A and 7 show examples of the acoustic signal editing system which processes a single channel of input acoustic signal x(t), the FIG. 21 embodiment shows a system into which two channels of acoustic signals $x_1(t)$ and $x_2(t)$ are input. output acoustic signals from acoustic signal processing parts 23$L_1$, 23$R_1$, 23$L_2$, 23$R_2$ are mixe d for each of left and right channels ov $e_r$ the respective input routes to produce a single left- and right-channel acoustic signal.

To input terminals 21$_1$ and 21$_2$ are applied acoustic signals $x_1$ and $x_2$ from a microphone in a recording studio, for instance, or acoustic signals $x_1$ and $x_2$ reproduced from a CD, a MD or an audio tape. These acoustic signals $x_1$ and $x_2$ are branched into left and right channels and fed to the left and right acoustic signal processing parts 23$L_1$, 23$R_1$ and 23$L_2$, 23$R_2$, wherein they are convolved with preset acoustic transfer functions $s_l(\theta_1)$, $s_r(\theta_1)$ and $s_l(\theta_2)$, $S_r(\theta_2)$ from a sound localization transfer function table, where $\theta_1$ and $\theta_2$ indicate target positions (direction in this case) for sounds (the acoustic signals $x_1$, $x_2$) of the first and second routes, respectively. The outputs from the acoustic signal processing parts 23$L_1$, 23$R_1$ and 23$L_2$, 23$R_2$ fed to left and right mixing parts 28L and 28R, wherein acoustic signals of each corresponding channel are mixed together, and the mixed outputs are provided as left- and right-channel acoustic signals $y_l(t)$ and $y_r(t)$ via output terminals 31L and 31R to headphones 32 or a recording device 33 for recording on a CD, a MD or an audio tape.

The target position setting part 25 specified target location signals $\theta_1$ and $\theta_2$, which are applied to the acoustic function table storage part 24. The acoustic transfer function table storage part 24 has stored therein the acoustic transfer function table for virtual sound localization use made as described previously herein, from which sound localization transfer functions $s_l(\theta_1)$, $s_r(\theta_1)$ and $s_l(\theta_2)$, $s_r(\theta_2)$ corresponding to the target location signals $\theta_1$ and $\theta_2$ are set in the acoustic signal processing parts 23$L_1$, 23$R_1$, 23$L_2$ and 23$R_3$, respectively. Thus, the majority of potential listeners can localize the sounds (the acoustic signals $x_1$ and $x_2$) of the channels 1 and 2 at the target positions $\theta_1$ and $\theta_2$, respectively.

In the FIG. 21 embodiment, even if the acoustic transfer characteristics $g^*_l(\theta_1)$, $g^*_r(\theta_1)$, $g^*_l(\theta_2)$ and $g^*_r(\theta_2)$ are used in place of the sound localization transfer functions $s_l(\theta_l)$, $S_r(\theta)$, $s_l(\theta_2)$ and $s_r(\theta_2)$ and output acoustic signals $y_l$ and $y_r$ are reproduced by using loudspeakers, the majority of potential listeners can similarly localize the sounds of the channels 1 and 2 at the positions $\theta_1$ and $\theta_2$.

By sequential processing for setting the sound localization transfer functions $s_l(\theta_1)$, $s_r(\theta_1)$, $S_l(\theta_2)$ and $s_r(\theta_2)$ or transaural transfer functions $g^*_l(\theta_1)$, $g^*_r(\theta_1)$, $g^*_l(\theta_2)$ and $g^*_r(\theta_2)$, it is possible to edit in real time an acoustic signal that makes a listener perceive a moving sound image. The acoustic transfer function table storage part 24 can be formed by a memory such as a RAM or ROM. In such a memory sound localization transfer functions $s_l(\theta)$ and $s_r(\theta)$ or transaural transfer functions $g^*_l(\theta)$ and $g^*_r(\theta)$ are prestored according to all possible target positions θ.

Figure 2:
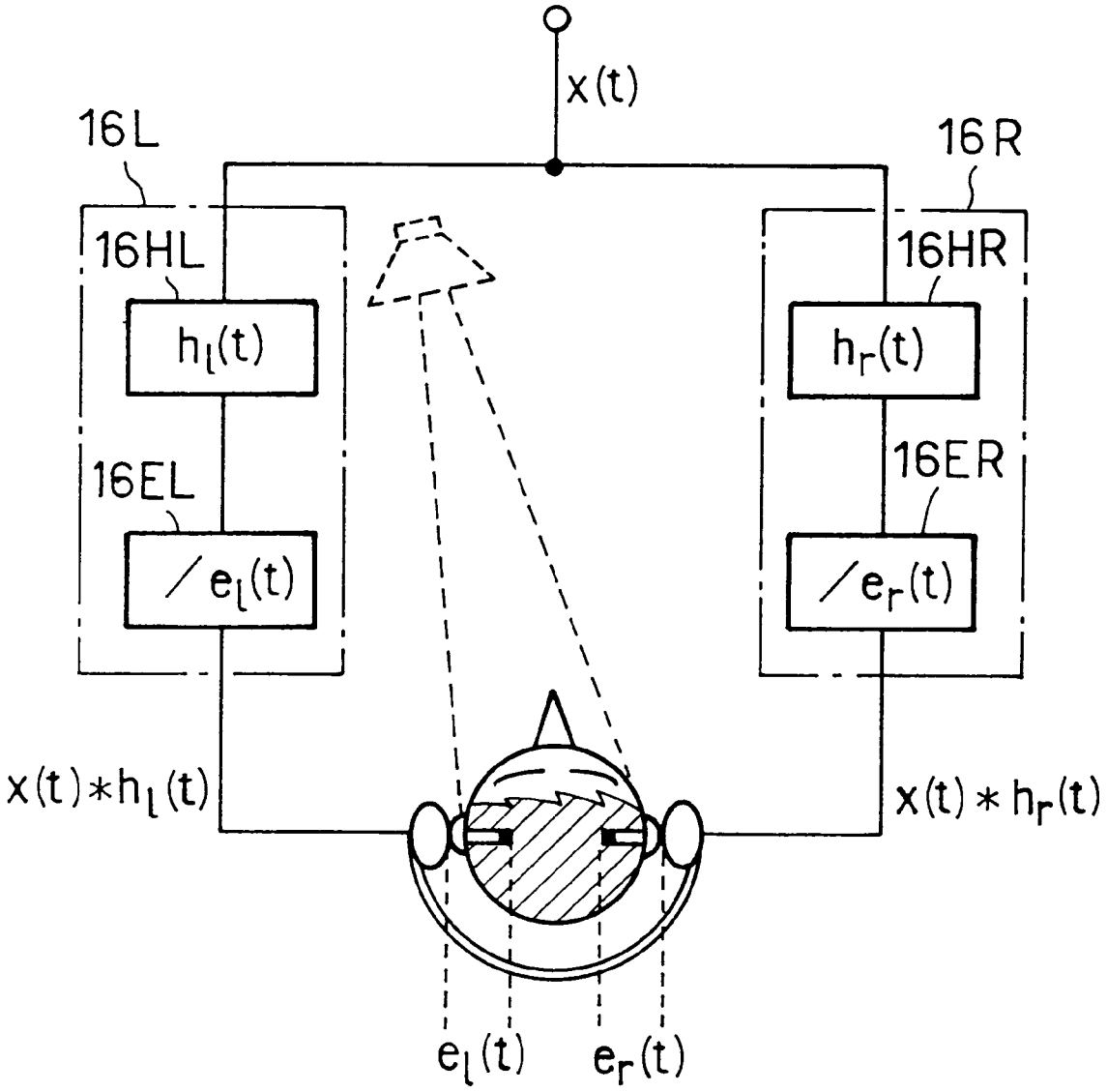
FIG. 2 is a diagram showing a scheme for implementing virtual sound localization in case of handling the head related transfer functions and ear canal transfer functions separately in the sound reproduction system using headphones.

In the FIG. 21 embodiment, as in the case of FIG. 6A, the representatives determined from head related transfer functions $h_l(t)$, $h_r(t)$ and ear canal transfer functions $e_l(t)$, $e_r(t)$ measured from subjects are used to calculate the sound localization transfer functions $s_l(t)$ and $s_r(t)$ by deconvolution and, based on the data, representatives corresponding to each sound source location (sound source direction θ) are selected from the sound localization transfer functions $s_l(t)$ and $s_r(t)$ for constructing the transfer function table for virtual sound localization. It is also possible to construct the table by a method which does not involve the calculation of the sound localization transfer functions $s_l(t)$ and $s_r(t)$ as in FIG. 7 but instead selects the representatives corresponding to each target position (sound source direction θ) from the measured head related transfer functions $h_l(t)$ and $h_r(t)$ in the same manner as in FIG. 6A. In such an instance, a pair of $e^*_l(t)$ and $e^*_r(t)$ is selected, as representatives, from the transfer functions $e_l(t)$ and $e_r(t)$ measured for all the subjects in the same fashion as in FIG. 6A and is stored in a table. It is apparent from Eqs. (3a) and (3b) that processing of acoustic signals through utilization of this acoustic transfer function table for virtual sound localization can be achieved by forming the convolution part 16L in FIG. 1B by a cascade connection of a head related transfer function convolution part 16HL and an ear canal transfer function deconvolution part 16EL and the convolution part 16R by a cascade connection of a head related transfer function convolution part 16HR and an ear canal transfer function deconvolution part 16ER as shown in FIG. 2.

Incidentally, it is well-known that the existence of an inverse filter coefficient of a certain filter coefficient usually requires the latter to satisfy a minimum phase condition. That is, in the case of a deconvolution (inverse filter processing) with an arbitrary coefficient, the solution (output) diverges in general. The same goes for the deconvolutions by Eqs. (3a), (3b), (5a) and (5b) that are executed in the deconvolution parts 27C and 27H of the computing part 28 in FIGS. 6A and 8, and the solutions of the deconvolutions may sometimes diverge. The same is true of the deconvolution parts 23ER and 23RL in FIGS. 7 and 9. It is disclosed in A. V. Oppenheim et al, "Digital Signal Processing," PRENTICE-HALL, INC., 1975, for instance, that a use of a set of inverse filter coefficients in a minimum phase condition can avoid such a solution divergence by forming an inverse filter with phase-minimized coefficients. In the present invention, too, such a divergence in the deconvolution can be avoided by using phase-minimized coefficients in the deconvolution. The object to be phase minimized is coefficients which reflect the acoustic transfer characteristics from a sound source for the presentation of sound stimuli to the listener's ears.

For example, $e_l(t)$ and $e_r(t)$ in Eqs. (3a) and (3b), $s_p(t)*e_l(t)$ and $s_p*e_r(t)$ in Eqs. (3A') and (3b'), or $\Delta e$ or $s_p(t)*\Delta e$ in Eqs, (5a) and (5b) are the objects of phase minimization.

When the number of elements in an acoustic transfer function (filter length: n) is a power of 2, the operation of phase minimization (hereinafter identified by MP) is conducted by using Fast Fourier Transforms (FFTS) as follows:

$$MP\{h\}=FFT^{-1}(\exp\{FFT(W(FFT^{-1}(\log|FFT(h)|))\} \quad (17)$$

where $FFT^{-1}$ indicates an inverse Fast Fourier Transform and W(A) a window function for a filter coefficient vector A, but the first and the (n/2+1)-th elements of A are kept unchanged. The second to the (n/2)-th elements of A are doubled and (n/2+2)-th and the remaining elements are set at zero.

The amplitude-frequency characteristics of the acoustic transfer function is invariable even after being subjected to the phase minimization. Further, an interaural time difference is mainly contributed by the head related transfer functions HRTF. In consequence, the interaural time difference, the level difference and the frequency characteristics which are considered as cues for sound localization are not affected by the phase minimization.

A description will be given below of an example of the configuration of the computing part 27 in the case of the phase minimization being applied to the embodiments of FIGS. 6A to 8 so as to prevent instability of the outputs due to the deconvolution.

Figure 22:
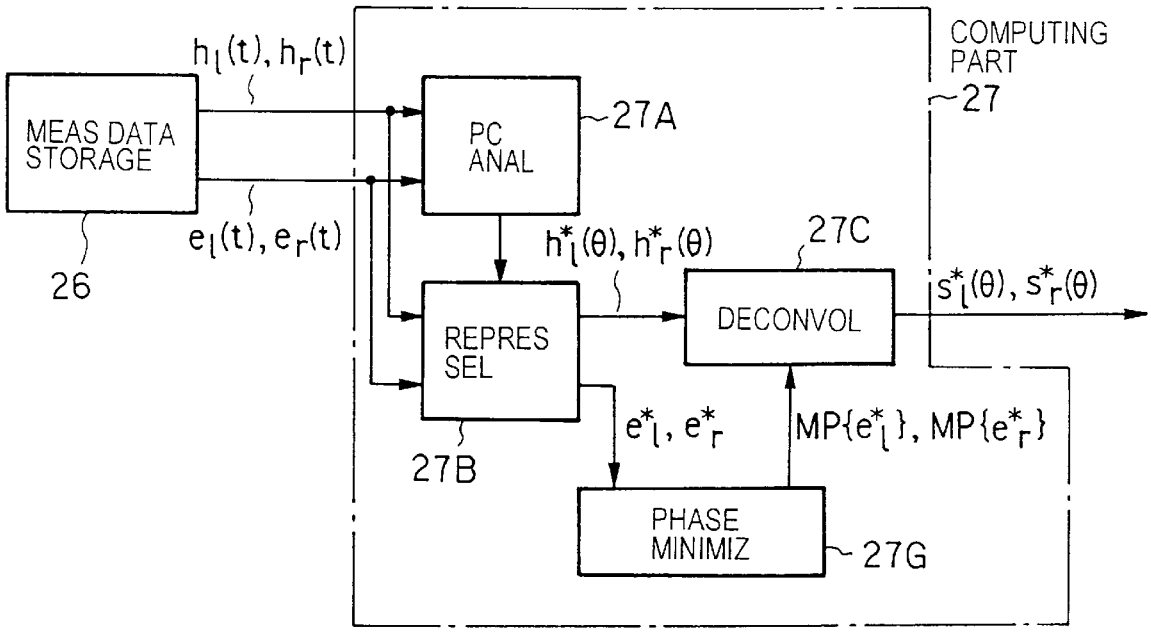
FIG. 22 illustrates a block diagram of the configuration of the computing part 27 in FIG. 6A employing a phase minimization scheme.

FIG. 22 illustrates the application of the phase minimization scheme to the computing part 27 in FIG. 6A. A phase minimization part 27G is disposed in the computing part 27 to conduct phase-minimization of the ear canal transfer functions $e^*_l$ and $e^*_r$ determined in the representative selection part 27B. The resulting phase-minimized representatives $MP\{e^*_l\}$ and $MP\{e^*_r\}$ are provided to the deconvolution part 27C to perform the deconvolutions as expressed by Eqs. (3a) and (3b). The sound localization transfer functions $s^*_l(\theta)$ and $s^*_r(\theta)$ thus obtained are written into the transfer function table storage part 24 in FIG. 6A.

Figure 23:
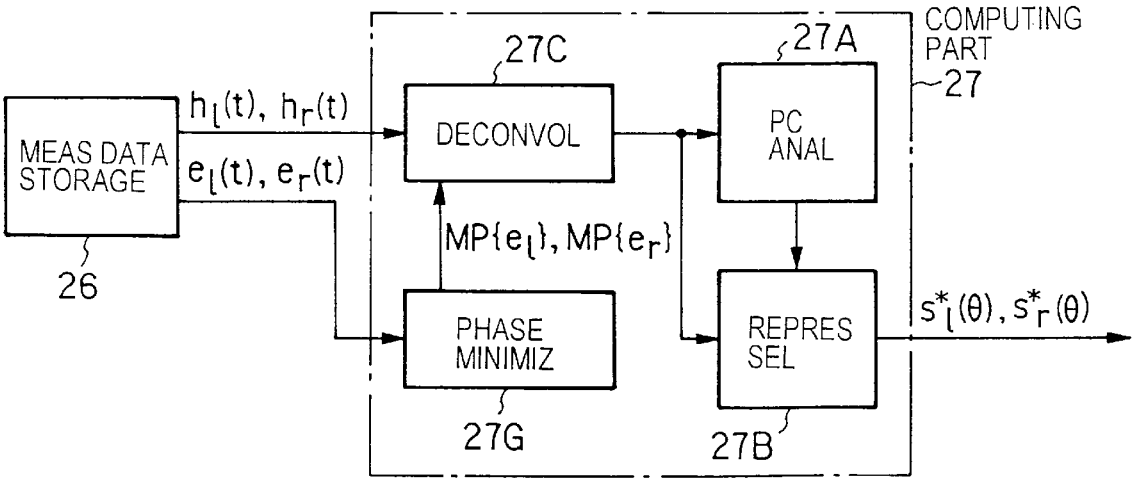
FIG. 23 illustrates a block diagram of a modified form of the computing part 27 of FIG. 22.

FIG. 23 illustrates a modified form of the FIG. 22 embodiment, in which phase-minimization of the ear canal transfer functions $e_l(t)$ and $e_r(t)$ stored in the measured data storage part 26 are conducted in the phase minimization part 27G prior to their principal components analysis. The resulting phase-minimized transfer functions $MP\{e_r\}$ and $MP\{e_l\}$ are provided to the deconvolution part 27C wherein they are used to deconvolve, for each subject, the head related transfer functions $h_r(t)$ and $h_l(t)$ for each target position. The sound localization transfer functions $s_r(t)$ and $s_l(t)$ obtained by the deconvolution are subjected to the principal components analysis and the representatives $s^*_r(\theta)$ and $s^*_l(\theta)$ determined for each target position θ are written into the transfer function table storage part 24 in FIG. 6A.

Figure 24:
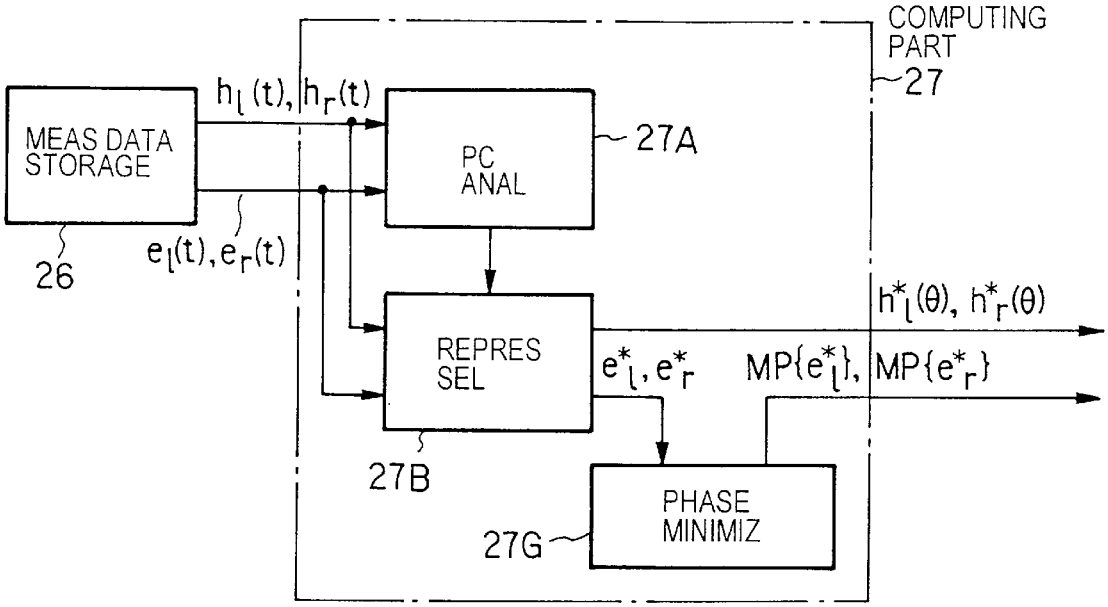
FIG. 24 illustrates a block diagram of the configuration of the computing part 27 in FIG. 7 employing the phase minimization scheme.

FIG. 24 illustrates the application of the phase minimization scheme conducted in the computing part 27 in FIG. 7. In the computing part 27 in FIG. 24 the phase minimization part 27G is provided for phase minimization by the representatives of ear canal transfer function $e^*_l$ and $e^*_r$ determined in the representative selection part 27B. The phase-minimized representatives $MP\{e^*_l\}$ and $MP\{e^*_r\}$ obtained by the phase minimization are written into the transfer function table storage part 24 in FIG. 7 together with the head related transfer function representatives $h^*_r(\theta)$ and $h^*_l(\theta)$.

Figure 25:
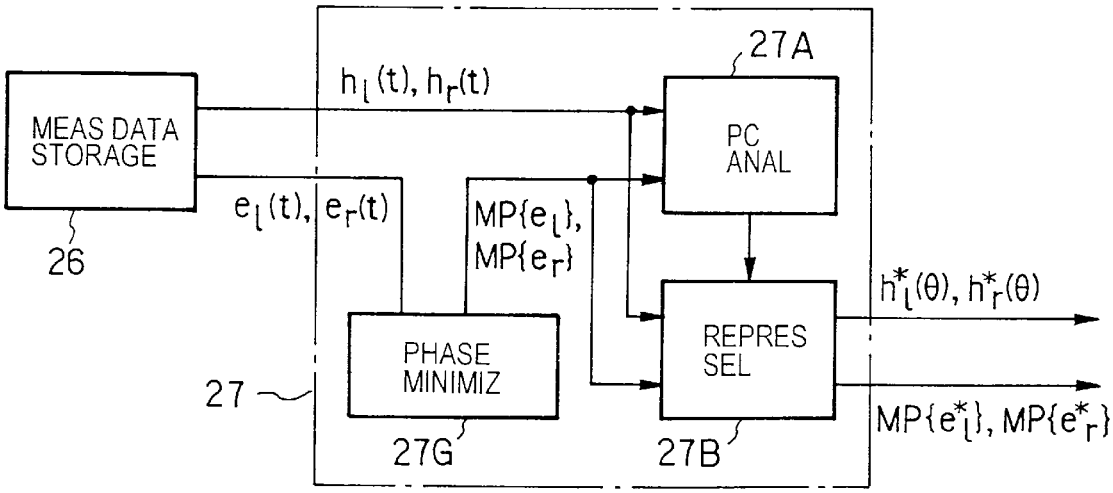
FIG. 25 illustrates a block diagram of a modified form of the computing part 27 of FIG. 24.

FIG. 25 illustrates a modified form of the FIG. 24 embodiment. Prior to the principal components analysis the ear canal transfer functions $e_l(t)$ and $e_r(t)$ stored in the measured data storage part 26 are subjected to phase minimization conducted in the phase minimization part 27G. The resulting phase-minimized ear canal transfer functions $MP\{e_r\}$ and $MP\{r_l\}$ are subjected to the principal components analysis in the principal components analysis part 27A in paralle$_l$ with the principal components analysis of the head related transfer functions $h_r(t)$ and $h_l(t)$ stored in the measured data storage part 26. Based on the results of the analysis, representatives are determined in the representative selection part 27B, respectively. Thus obtained phase-minimized representatives $MP\{e^*_l\}$, $MP\{e^*_r\}$ and the head related transfer functions $h^*_r(\theta)$, $h^*_l(\theta)$ are both written into the transfer function table storage part 24 in FIG. 7.

Figure 26:
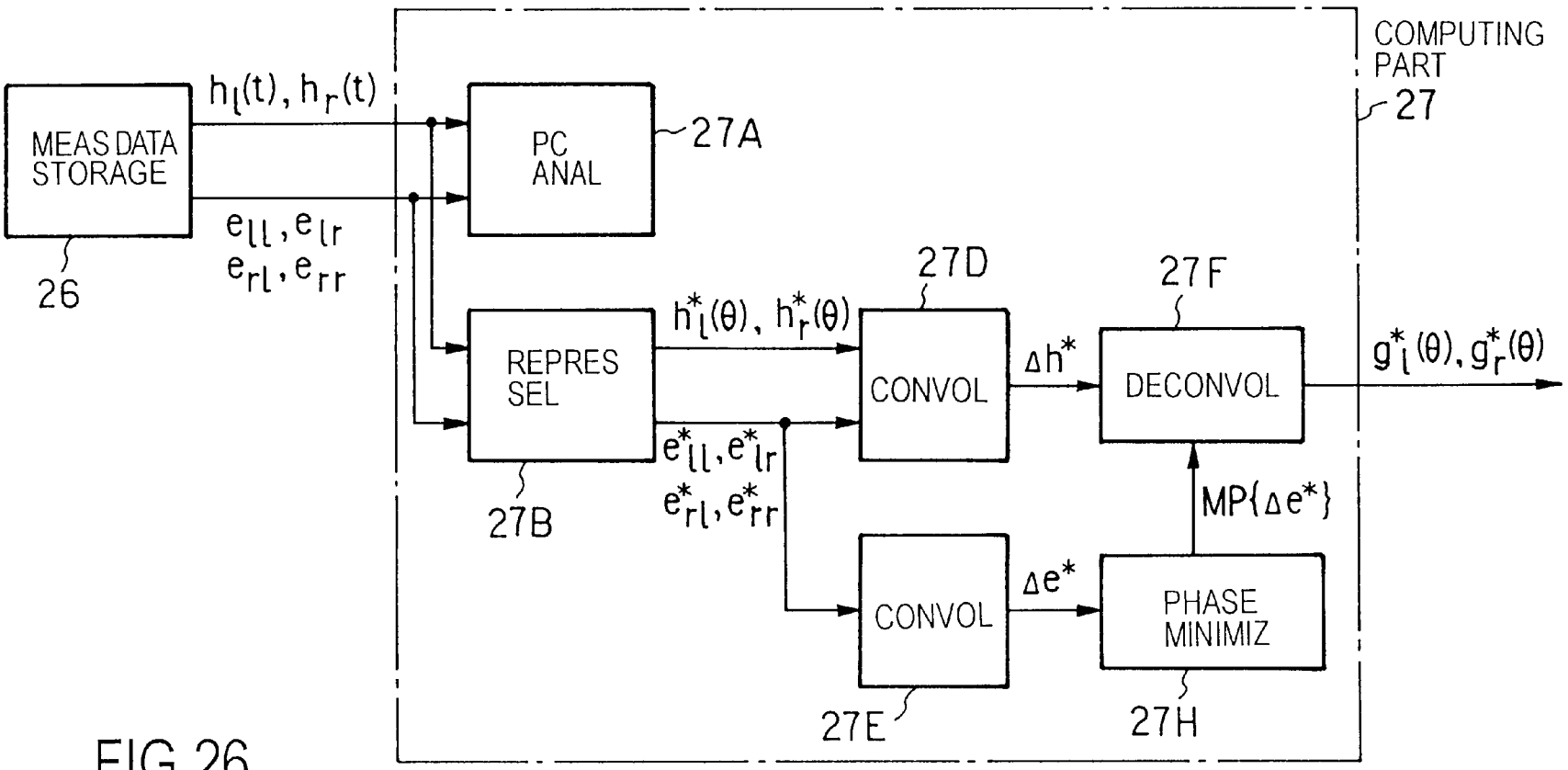
FIG. 26 illustrates a block diagram of the configuration of the computing part 27 in FIG. 8 employing the phase minimization scheme.

FIG. 26 illustrates the application of the phase minimization scheme conducted in the computing part 27 in FIG. 8. The phase minimization part 27H is provided in the computing part 27 of FIG. 8 and the set of coefficients $\Delta e^*=\{e_{ll}*e_{rr}-e_{lr}*e_{rl}\}$ calculated in the convolution part 27E is subjected to phase minimization in the phase minimization art 27H. The resulting phase-minimized representative $MP\{\Delta e^*\}$ is provided to the deconvolution part 27F, wherein it is used for the deconvolution of the representatives of head related transfer functions $\Delta h^*_r(\theta)$ and $\Delta h^*_l(\theta)$ obtained from the convolution part 27D according to Eqs. (5a) and (5b). The thus obtained sound localization transfer functions $g^*_r(\theta)$ and $g^*_l(\theta)$ are written into the transfer function table storage part 24.

Figure 27:
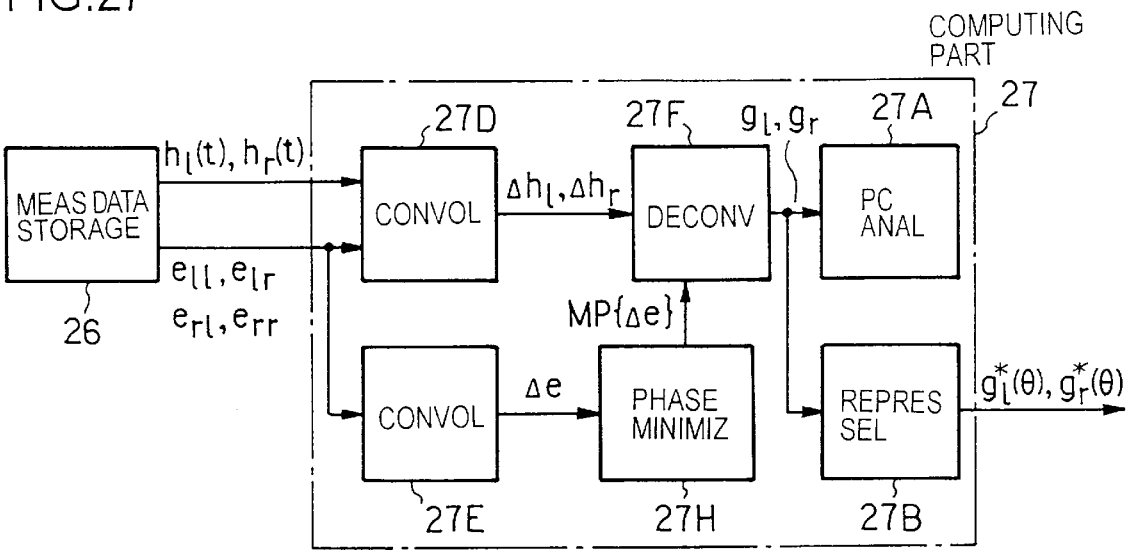
FIG. 27 illustrates a block diagram of a modified form of the computing part 27 of FIG. 26.

FIG. 27 illustrates a modified form of the FIG. 26 embodiment, in which a series of processing of the convolution parts 27D and 27E, the phase minimization part 27H and the deconvolution part 27F in FIG. 27 is carried out for all the measured head related transfer functions $h_r(t)$, $h_l(t)$ and ear canal transfer functions $e_r(t)$, $e_{rl}(t)$, $e_{lr}(t)$, $e_{ll}(t)$ prior to principal components analysis. The resulting transaural transfer functions $g_r(t)$ and $g_l(t)$ are subjected to the principal components analysis. Based on the results of analysis, the representatives $g^*_r(\theta)$ and $g^*_l(\theta)$ of the transfer functions are determined and written into the transfer function table storage part 24 as shown in FIG. 8.

Figure 28:
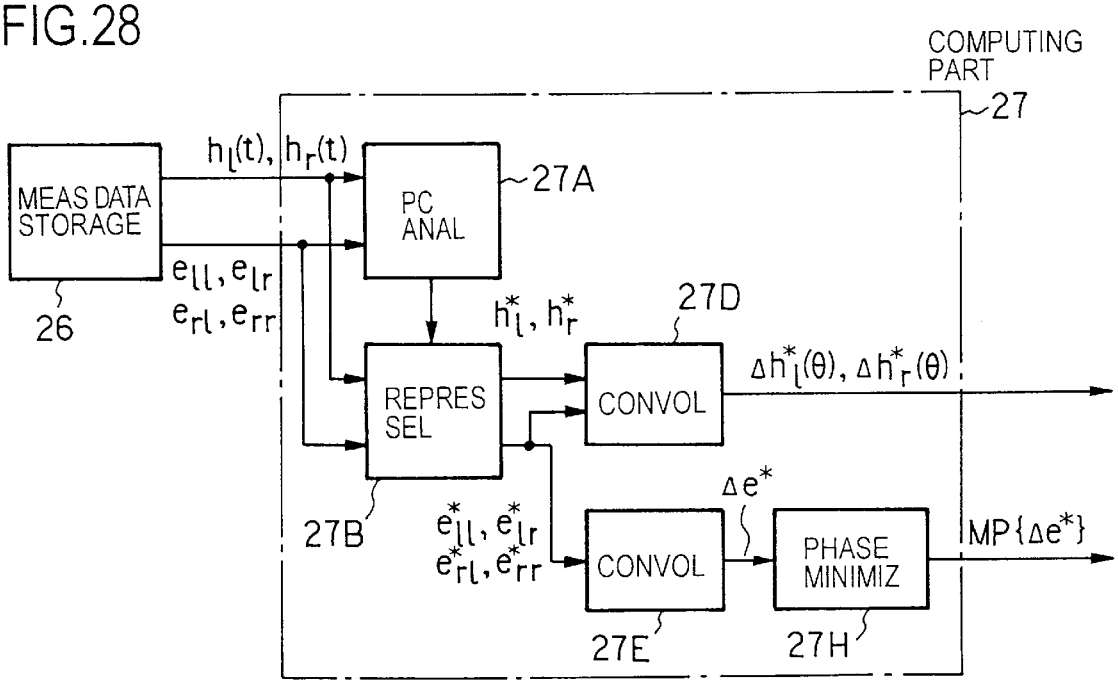
FIG. 28 illustrates a block diagram of the configuration of the computing part 27 in FIG. 9 employing the phase minimization scheme.

FIG. 28 illustrates the application of the phase minimization scheme conducted in the computing part 27 of FIG. 9. The phase minimization part 27H is provided in the computing part 27 in FIG. 28 and the representative $\Delta e^*=\{e_{ll}*e_{rr}-e_{lr}*e_{rl}\}$ calculated in the convolution part 27E is subjected to the phase minimization conducted in the phase minimization part 27H. The resulting phase-minimized set of coefficients $MP\{\Delta e^*\}$ is written into the transfer function table storage part 24 together with the representatives $\Delta h^*_r(\theta)$ and $\Delta h^*_l(\theta)$.

Figure 29:
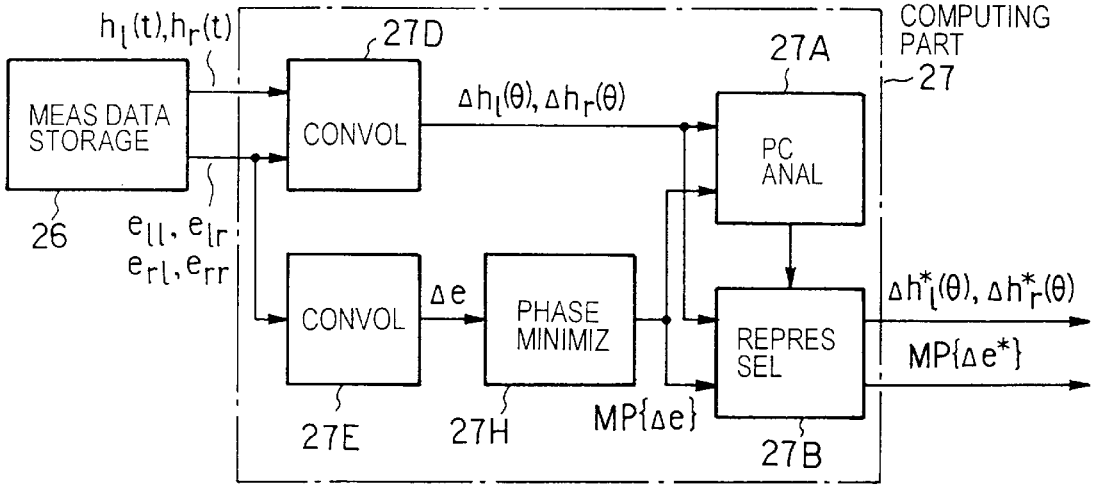
FIG. 29 illustrates a block diagram of a modified form of the computing part 27 of FIG. 28.

FIG. 29 illustrates a modified form of the FIG. 28 embodiment, in which a series of processing of the convolution parts 27D and 27E and the phase minimization part 27H in FIG. 27 is carried out for all the measured head related transfer functions $h_r(t)$, $h_l(t)$ and ear canal transfer functions $e_{rr}(t)$, $e_{rl}(t)$, $e_{lr}(t)$, $e_{ll}(t)$ prior to principal components analysis. The resulting sets of coefficients $\Delta h_r(t)$, $\Delta h_l(t)$ and $MP\{\Delta e\}$ are subjected to principal components analysis. Based on the results of analysis, the representatives $\Delta h^*_r(\theta)$, and $\Delta h^*_l(\theta)$ and $MP\{\Delta e^*\}$ are determined and written into the transfer function table storage part 24 in FIG. 9.

Figure 30:
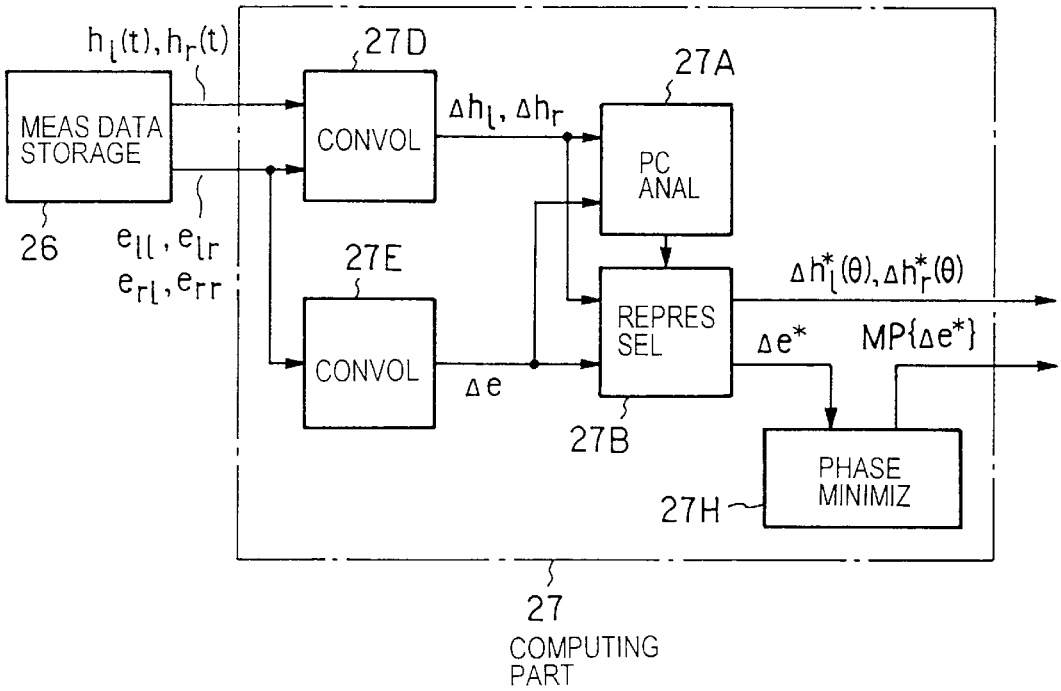
FIG. 30 illustrates a block diagram of a modified form of the computing part 27 of FIG. 29.

FIG. 30 illustrates a modified form of the FIG. 29 embodiment, which differs from the latter only in that the phase minimization part 27H is provided at the output side of the representative selection part 27B to conduct phase minimization of the determined representative $\Delta e^*$.

Effect of the Invention

As described above, according to the method of constructing acoustic transfer function table for virtual sound localization by the present invention, a pair of left and right acoustic transfer functions for each target position can be determined from acoustic transfer functions, which were measured for a large number of subjects, with a reduced degree of freedom on the basis of the principal components analysis. With the use of the transfer function table constructed from such acoustic transfer functions, acoustic signals can be processed for enabling the majority of potential listeners accurately to localize sound images.

Furthermore, by using the Mahalanobis' generalized distance as the distance of the amplitude-frequency characteristics, the acoustic transfer functions can be determined taking into account the coarseness or denseness of the probability distribution of the acoustic transfer functions, irrespective of the absolute value of variance or covariance.

Besides, by determining that the acoustic transfer function from one target position to one ear and the acoustic transfer function from another target position laterally symmetrical in azimuth to the former one to the other ear are identical, the number of acoustic transfer functions necessary for selection or the amount of information for storage of the selected acoustic transfer functions can be reduced by half.

In the transfer function table constructing method according to the present invention, the deconvolution using a set of coefficients reflecting the phase-minimized acoustic transfer functions from the sound source to each ear can avoid instability of the resulted sound localization transfer functions or transaural transfer functions and hence instability of the output acoustic signal.

We claim:

1. A method for constructing an acoustic transfer function table for virtual sound localization, comprising the steps of:

(a) conducting principal components analysis of premeasured acoustic transfer functions from a plurality of target sound source positions to left and right ears of a plurality of subjects to obtain weighting vectors corresponding to said acoustic transfer functions;

(b) calculating a centroid vector of said weighting vectors for each of said target sound source positions and each of said left and right ears;

(c) calculating a distance between said centroid vector and each of said weighting vectors for each of said target sound source positions and each of said ears; and (d) determining, as a representative for each of said target sound source positions, an acoustic transfer function corresponding to that one of said weighting vectors for each of said target sound source positions which minimizes said distance, and using said representative to construct said transfer function table for virtual sound localization.

2. The method for constructing an acoustic transfer function table for virtual sound localization according to claim 1, wherein said step (d) includes a step of writing said determined representative as an acoustic transfer function for virtual sound localization into a memory in correspondence with each of said target sound source positions and each of said ears.

3. The method for constructing an acoustic transfer function table for virtual sound localization according to claim 1, which uses a Mahalanobis' generalized distance as said distance.

4. The method for constructing an acoustic transfer function table for virtual sound localization according to claim 1, wherein a representative of acoustic transfer function from one of said target sound source positions to one of said left and right ears and an acoustic transfer function representative from a target sound source position of an azimuth laterally symmetrical to said each target sound source position to the other ear are determined as the same value.

5. The method for constructing an acoustic transfer function table for virtual sound localization according to claim 1, wherein said premeasured acoustic transfer functions are head related transfer functions from each of said target sound source positions to each of said left and right ears, and each of left and right ear canal transfer functions, respectively, and representatives of said head related transfer functions each of said target sound source positions and each of said ears and representatives of said ear canal transfer functions are determined as said representatives.

6. The method for constructing an acoustic transfer function table for virtual sound localization according to claim 5, characterized by a step of calculating sound localization transfer functions by deconvolving, with said representatives of said ear canal transfer functions, said representatives of said head related transfer functions for each of said target sound source positions and each of said ears.

7. The method for constructing an acoustic transfer function table for virtual sound localization according to claim 6, which includes a step of phase-minimizing said ear canal transfer functions prior to said deconvolution.

8. The method for constructing an acoustic transfer function table for virtual sound localization according to claim 1, wherein said premeasured acoustic transfer functions are head related transfer functions composed of two sequences of coefficients from each of said target sound source positions to the eardrum of each of said left and right ears and acoustic transfer functions composed of four sequences of coefficients from each of left and right sound sources to each of said left and right ears, and letting said two head related transfer functions and said four acoustic transfer characteristics be represented by $h_l(t)$, $h_r(t)$ and $e_{ll}(t)$, $e_{lr}(t)$, $e_{rl}(t)$, $e_{rr}(t)$, respectively, said representatives are representatives $h^*_l(t)$ and $h^*_r(t)$ of said two head related transfer functions and representatives $e^*_{ll}(t)$, $e^*_{lr}(t)$, $e^*_{rl}(t)$ and $e^*_{rr}(t)$ of said four acoustic transfer functions for each of said target sound source positions, and transfer characteristics $g_l(t)$ and $g_r(t)$ obtained by the following calculations in said step (d) are written into a memory as said acoustic transfer functions for virtual sound localization:

$$g_l(\theta,t)=\{e^*_{rr}(t)*h^*_l(\theta,t)-e^*_{rl}(t)*h^*_r(\theta,t)\}/\{e^*_{ll}(t)*e^*_{rr}(t)-e^*_{lr}(t)*e^*_{rl}(t)\}$$

$$g_r(\theta,t)=\{e^*_{ll}(t)*h^*_r(\theta,t)-e^*_{lr}(t)*h^*_l(\theta,t)\}/\{e^*_{ll}(t)*e^*_{rr}(t)-e^*_{lr}(t)*e^*_{rl}(t)\}$$

where "/" indicates a deconvolution.

9. The method for constructing an acoustic transfer function table for virtual sound localization according to claim 8 wherein said acoustic transfer functions $e_{ll}(t)$ and $e_{rr}(t)$ composed of left and right sequences of coefficients from each of said sound sources to each of said left and right ears are substituted for said left and right ear canal transfer functions.

10. The method for constructing an acoustic transfer function table for virtual sound localization according to claim 1 or 2, wherein said premeasured acoustic transfer functions are head related transfer functions composed of sequences of left and right coefficients from each of said target sound source positions to each of said left and right ears and acoustic transfer functions composed of four sequences of coefficients from each of left and right sound sources to each of said left and right ears, and letting said two head related transfer functions and said four acoustic transfer functions be represented by $h_l(t)$, $h_r(t)$ and $e_{ll}(t)$, $e_{lr}(t)$, $e_{rl}(t)$, $e_{rr}(t)$, respectively, said representatives are those of said two head related transfer functions $h^*_l(t)$ and $h^*_r(t)$ and those of said four acoustic transfer functions $e^*_{ll}(t)$, $e^*_{lr}(t)$, $e^*_{rl}(t)$ and $e^*_{rr}(t)$ for each of said target sound source positions, and other transfer functions $\Delta h^*_r(t)$, $\Delta h^*_l(t)$ and $\Delta e^*$ obtained by the following calculations in said step (d) are written into a memory as said left and right acoustic transfer functions for virtual sound localization:

$$\Delta h^*_r(\theta,t)=\{e^*_{rr}(t)*h^*_l(\theta,t)-e^*_{rl}(t)*h^*_r(\theta,t)\}$$

$$\Delta h^*_l(\theta,t)=\{e^*_{ll}(t)*h^*_r(\theta,t)-e^*_{lr}(t)*h^*_l(\theta,t)\}$$

$$\Delta e^*(t)=\{e^*_{ll}(t)*e^*_{rr}(t)-e^*_{lr}(t)*e^*_{rl}(t)\}$$

11. The method for constructing an acoustic transfer function table for virtual sound localization according to claim 1, 2, or 3, wherein a deconvolution in the calculation of generating said acoustic transfer functions for virtual sound localization uses a sequence of coefficients, in a minimum phase condition, obtained from at least one of said acoustic transfer functions.

12. The method for constructing an acoustic transfer function table for virtual sound localization according to claim 1, which includes a step of imposing a minimum phase condition on processing of said premeasured left and right ear canal transfer functions, and wherein said left and right ear canal transfer functions in a minimum phase condition are used to deconvolve head related transfer functions from each of said target sound source positions to each of said left and right ears to obtain sound localization transfer functions as said acoustic transfer functions.

13. The method for constructing an acoustic transfer function table for virtual sound localization according to claim 8, which includes a step of imposing the following coefficient sequence on a minimum phase condition prior to said deconvoltion for obtaining said acoustic transfer functions $g_l(t)$ and $g_r(y)$:

$$\{e^*_{ll}(t)*e^*_{rr}(t)-e^*_{lr}(t)*e^*_{rl}(t)\}$$

14. The method for constructing an acoustic transfer function table for virtual sound localization according to claim 10, which includes a step of imposing said acoustic transfer function $\Delta e^*(t)$ obtained as said representative on a minimum phase condition prior to its writing into said memory.

15. An acoustic transfer function table for virtual sound localization constructed by the said method of claim 1.

16. A memory manufacturing method, characterized by recording an acoustic transfer function table for virtual sound localization constructed by the said method of claim 1.

17. A memory in which there are recorded said acoustic transfer function table for virtual sound localization made by the method of claim 1.

18. An acoustic signal editing method which has at least one path of generating a series of stereo acoustic signals by reading out of the acoustic transfer function table for virtual sound localization constructed by the method of claim 1 acoustic transfer functions according to left and right channels and to a designated target sound source position and by convolving input monaural acoustic signals of respective paths with said read-out acoustic transfer functions according to said left and right channels.

19. An acoustic signal editing method which has at least one path in which head related transfer functions $h^*_l(\theta,t)$ and $h^*_r(\theta,t)$ according to a designated target sound source position $\theta$ and for each of left and right channels and ear canal transfer functions $e^*_l(t)$ and $e^*_r(t)$ according to left and right ears, respectively, are read out, as coefficients to be used respectively in convolution and deconvolution, from an acoustic transfer function table for virtual sound localization constructed by the method of claim 5, and a convolution and a deconvolution of respective path of input monaural acoustic signals are conducted in tandem for each of said left and right channels, using said coefficients.

20. An acoustic signal editing method which has at least one path in which transfer characteristics $\Delta h^*_l(\theta,t)$ and $\Delta h^*_r(\theta,t)$ according to a designated target sound source position $\theta$ and for each of left and right ears and a transfer function $\Delta e^*(t)$ are read out, as coefficients to be used respectively in convolution and deconvolution from an acoustic transfer function table for virtual sound localization constructed by the method of claim 6 or 7, and a convolution and a deconvolution of respective path of monaural acoustic signals are conducted in tandem for each of said left and right channels, using said transfer functions $\Delta h^*_l(\theta,t)$, $\Delta h^*_r(\theta,t)$ for said convolution and said transfer function $\Delta e^*(t)$ for said deconvolution.

* * * * *